US007603072B2

(12) United States Patent
Yokobori et al.

(10) Patent No.: US 7,603,072 B2
(45) Date of Patent: Oct. 13, 2009

(54) IMAGE FORMING APPARATUS, IMAGE FORMING SYSTEM AND PROGRAM FOR IMAGE FORMING

(75) Inventors: Jun Yokobori, Sagamihara (JP); Masaru Ushio, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 405 days.

(21) Appl. No.: 11/410,134

(22) Filed: Apr. 25, 2006

(65) Prior Publication Data

US 2007/0166088 A1 Jul. 19, 2007

(30) Foreign Application Priority Data

Jan. 19, 2006 (JP) ..... 2006-011138

(51) Int. Cl.
*G03G 15/00* (2006.01)

(52) U.S. Cl. ..... 399/382; 399/381; 399/405; 271/3.19

(58) Field of Classification Search ..... 399/382
See application file for complete search history.

(56) References Cited

U.S. PATENT DOCUMENTS 5,133,048 A 7/1992 Parsons et al.
5,710,968 A * 1/1998 Clark et al. ..... 399/382

FOREIGN PATENT DOCUMENTS

JP 04361083 A * 12/1992
JP 2728812 12/1997
JP 2002-3063 1/2002
JP 2003-040517 2/2003

* cited by examiner

*Primary Examiner*—Judy Nguyen
*Assistant Examiner*—Allister Primo
(74) *Attorney, Agent, or Firm*—Finnegan, Henderson, Farabow, Garrett & Dunner, L.L.P.

(57) ABSTRACT

An image forming apparatus comprises a conveyance section which conveys at least one sheet of a second special sheet group so as to be inserted between two special sheets of a first special sheet group on a stacking section. A rest of special sheets which belong to the same set as a special sheet of the second special sheet group having been last supplied is supplied and ejected to a sheet ejection destination other than the stacking section before a special sheet of the second special sheet group is inserted after the latter sheet of the two special sheets of the first special sheet group are supplied.

21 Claims, 11 Drawing Sheets

IMAGE FORMING APPARATUS, IMAGE FORMING SYSTEM AND PROGRAM FOR IMAGE FORMING

This application is based on Japanese Patent Application No. 2006-011138 filed on Jan. 19, 2006, in Japanese Patent Office, the entire content of which is hereby incorporated by reference.

TECHNICAL FIELD

The present invention relates to an image forming apparatus, an image forming system and a program for image forming.

BACKGROUND

There has been known a technology wherein there is used a special sheet group in which plural special sheets each being different in terms of a kind such as plural tab sheets each being different in terms of tab position or plural color sheets each being different in terms of color, are arranged in the predetermined order to form one set, in an image forming apparatus such as a copying machine or a printer, and special sheets are inserted in established pages in the course of printing, to make printed objects. In the generation of printed objects employing the special sheets as stated above, a right sheet needs to be inserted in a right position.

Namely, in generation of printed objects employing a group of special sheets, the special sheets need to be inserted in the predetermined order in sequence from the forefront of the printed objects each having thereon images formed. However, when the number of special sheets used for printing for one printed object is not an integral multiple of the number of special sheets per one set, unwanted special sheets are generated each time printing of one printed object is completed. For example, when one set shown in FIG. 10(*a*) uses a group of tab sheets in 5-tab structure, and printing for the first printed object is carried out by setting an insertion position of a tab sheet in each printed object to be "after obverse cover/back cover/2 pages", tab sheets up to the third tab are used. If the second printed object is printed without taking any action, a tab sheet of the fourth tab is inserted as an obverse cover, which is a trouble.

To solve this trouble, therefore, there has been disclosed a technology wherein, when the number of tabs to be used for one printed object, for example, is not an integral multiple of the number of tab positions, namely, the number of sheets with tabs constituting one set, the excessive sheets each having a tab are ejected (for example, see Patent Document 1).

For example, as shown in FIG. 9, when conducting printing by using a group of tab sheets in which one set is composed of 5 tabs, and by setting an insertion position for a tab sheet in each printed object to be "after obverse cover/back cover/second page", a tab sheet can be inserted correctly even when printing the following printed object, by ejecting unwanted tab sheets equivalent to two sheets of fourth and fifth tabs, after completion of printing of one printed object and before the start of the following printing.

There is further disclosed a technology wherein judgment is made whether or not the excessive tab sheets are generated from the number of tab sheets for one set and the number of tab sheets to be inserted, and when excessive tab sheets are generated, the unwanted tab sheets are ejected to a place other than a default tray, after selection of sheet-ejection tray is made impossible (for example, see Patent Document 2).

Furthermore, there is disclosed a technology wherein those ejected as unwanted tab sheets are used as a divider for each printed object, for resource saving (for example, see Patent Document 3).

(Patent Document 1) Patent No. 2728812

(Patent Document 2) TOKUKAI No. 2002-3063

(Patent Document 3) TOKUKAI No. 2003-40517

However, in some cases, there are provided some "paragraphs" which divide each "chapter" into smaller parts, in addition to "chapter" serving as a large partition, in the printed objects, and tab sheets each being different each other in type are inserted in respective partitions. Since each of the aforesaid Patent Documents 1-3 is one wherein a special sheet is ejected in the case of using a group of special sheets of one type, it is not possible to eject properly unwanted special sheets when using a group of special sheets of plural types, and an order of special sheets to be inserted in printed objects is disturbed, which has been a problem.

For example, when a group of tab sheets in 3-tab structure for one set and a group of tab sheets in 5-tab structure for one set are used as shown in FIG. 11(*a*), and a group of tab-sheets in 3-tab structure is used as a divider of "chapter" and a group of tab-sheets in 5-tab structure is used as a divider of "paragraph", tab sheets are inserted as shown in FIG. 11(*b*) in the conventional technology. Namely, FIG. 11 shows how tab sheets are inserted, when generating printed objects under the condition that an insertion position of a tab sheet of a group of tab sheets in 3-tab structure in each copy is set to be "cover/after fifth page/after tenth page", and an insertion position of a tab sheet of a group of tab sheets in 5-tab structure is set to be "after first page/after third page/after sixth page/after eighth page/after eleventh page/after thirteenth page". In this case, as shown in FIG. 11(*b*), a group of tab sheets in 5-tab structure does not return to the tab sheet of the first tab until all of five tab sheets are used up, even when printing of each chapter is terminated and second sheet of a group of tab sheets in 3-tab structure is inserted. Therefore, paragraph 1 and paragraph 2 of chapter 2 of the printed object become respectively third tab and fourth tab in 5-tab structure, while, paragraph 1 and paragraph 2 of chapter 3 become respectively fifth tab (first set) and first tab (second set) in 5-tab structure.

SUMMARY

In view of forgoing, an object of this invention is to solve at least one of the problems, and to provide new apparatus. The apparatus is an image forming apparatus, comprising:

a first supply section which supplies a special sheet of a first special sheet group, the first special sheet group including first special sheet sets, each set of which containing a plurality of different kind of special sheets arranged in a predetermined order;

a second supply section which supplies a special sheet of a second special sheet group, the special sheet of the second special sheet group being to be inserted between sheets of the first special sheet group, the second special sheet group including second special sheet sets, each set of which contains a plurality of different kind of special sheets arranged in a predetermined order;

a stacking section which stacks the special sheet supplied by the first supply section and the special sheet supplied by the second supply section;

a conveyance section which conveys at least one sheet of the second special sheet group so as to be inserted between two special sheets supplied by the first supply section on the stacking section; and a control section which controls the second supply section and the conveyance section so that a rest of special sheets which belong to the same set as a special sheet having been last supplied by the second supply section is supplied by the second supply section and is ejected to a sheet ejection destination other than the stacking section before a special sheet of the second special sheet group is inserted after the latter sheet of the two special sheets supplied by the first supply section.

According to another aspect of the present invention, another embodiment of the present invention is an image forming system, comprising:

an image forming apparatus which includes an image forming section forming an image on a recording medium based on input data; and a post-processing apparatus including a post-processing section which post-processes the recording medium after the image is formed on the recording medium by the image forming apparatus, wherein the image forming system includes a first supply section which supplies a special sheet of a first special sheet group, the first special sheet group including first special sheet sets, each set of which containing a plurality of different kind of special sheets arranged in a predetermined order;

a second supply section which supplies a special sheet of a second special sheet group, the special sheet of the second special sheet group being to be inserted between sheets of the first special sheet group, the second special sheet group including second special sheet sets, each set of which containing a plurality of different kind of special sheets arranged in a predetermined order;

a stacking section which stacks the special sheet supplied by the first supply section and the special sheet supplied by the second supply section;

a conveyance section which conveys at least one sheet of the second special sheet group so as to be inserted between two special sheets supplied by the first supply section on the stacking section; and a control section which controls the second supply section and the conveyance section so that a rest of special sheets which belong to the same set as a special sheet having been last supplied by the second supply section is supplied by the second supply section and is ejected to a sheet ejection destination other than the stacking section before a special sheet of the second special sheet group is inserted after the latter sheet of the two special sheets supplied by the first supply section.

According to another aspect of the present invention, another embodiment of the present invention is a program for enabling a computer to make an image forming system, which forms an image on a recording medium based on input data, execute a method, the method comprising the steps of:

conveying at least one special sheet of a second special sheet group including second special sheet sets, each set of which contains a plurality of different kind of special sheets arranged in a predetermined order so that a special sheet of the second special sheet group is inserted between special sheets of a first special sheet group on a stacking section, the first special sheet group including first special sheet sets, each set of which contains a plurality of different kind of special sheets arranged in a predetermined order; and supplying a rest of special sheets which belong to the same set as a special sheet of the second special sheet group having been last supplied and ejecting the rest to a sheet ejection destination before a special sheet of the second special sheet group is inserted after the latter sheet of the two special sheets supplied from the first special sheet group.

BRIEF DESCRIPTION OF THE DRAWINGS

FIG. 3(*b*) is a diagram for illustrating how tab sheets are inserted for the image forming system relating to the first embodiment.

FIG. 5(*b*) is a diagram for illustrating how tab sheets are inserted for the image forming system relating to the first embodiment.

FIG. 10(*b*) is a diagram for illustrating a process to eject unwanted tab sheets in a conventional technology.

FIG. 11(*b*) is a diagram for illustrating a process to eject unwanted tab sheets in a conventional technology.

DETAILED DESCRIPTION OF THE PREFERRED EMBODIMENT

An embodiment of an image forming system relating to the invention will be explained as a first embodiment as follows, referring to FIGS. 1-4, in which the scope of the invention is not limited to the illustrated examples.

Figure 1:
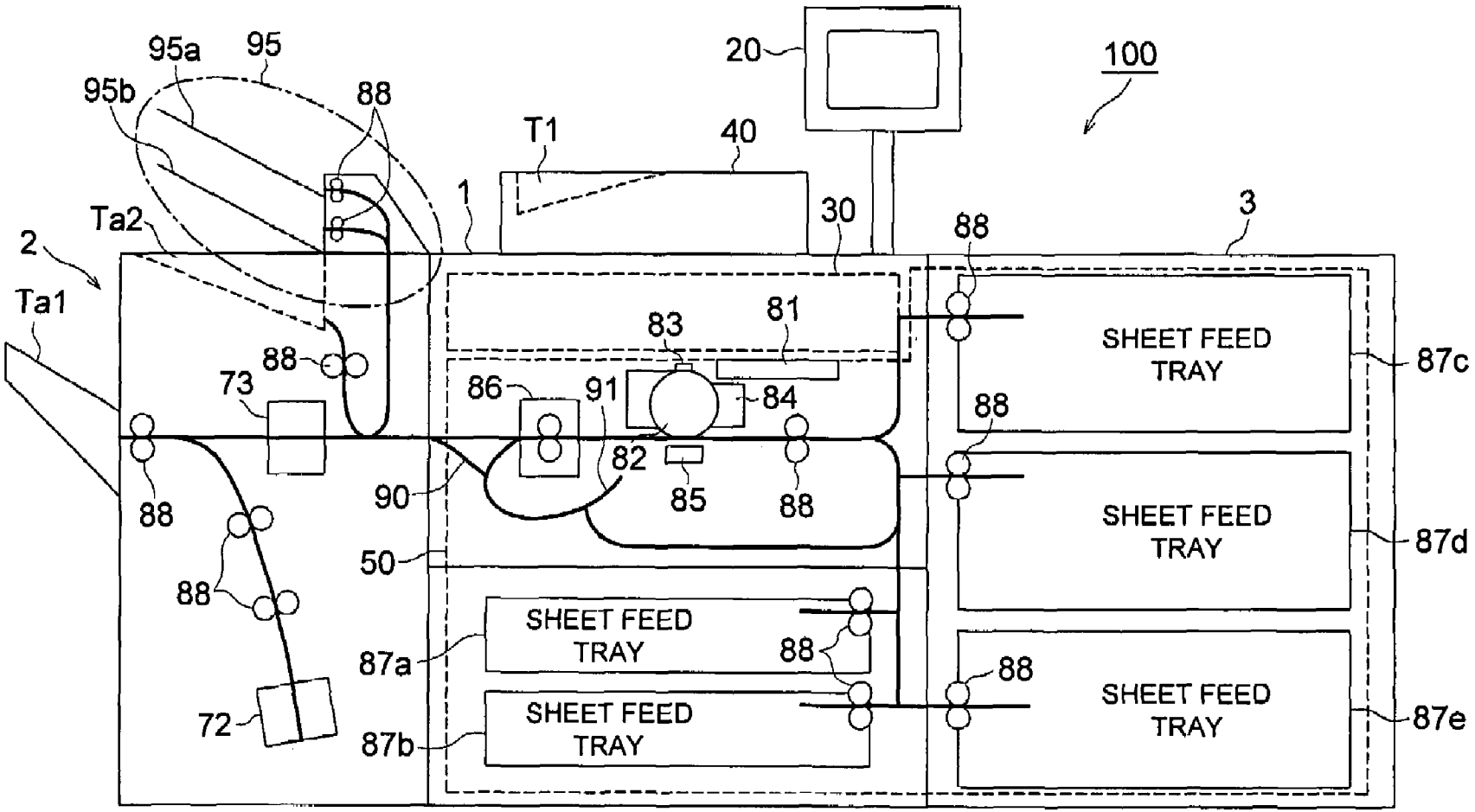
FIG. 1 is a schematic diagram showing an appearance structure and an internal structure of one embodiment of an image forming system relating to the invention.

FIG. 1 shows schematically the overall structure of image forming system 100 relating to the first embodiment. As shown in FIG. 1, the image forming system 100 includes image forming apparatus 1 that forms an image on a recording medium such as a transfer sheet and post-processing equipment (FNS; finisher) 2 that gives post-processing to the recording medium on which an image is formed by the image forming apparatus 1. In the present embodiment, large-capacity tray unit 3 capable of housing a large-capacity recording medium is connected to the image forming apparatus 1 on an optional basis.

First, the image forming apparatus 1 is, for example, a multi-functional machine of an electrophotographic type. Incidentally, the image forming apparatus 1 to which the invention can be applied is not limited to the multi-functional machine, but it may also be, for example, a copying machine, a printer and a fax machine. In the present embodiment, an explanation will be given hereafter referring to an example wherein a multi-functional machine of an electrophotographic type is applied as image forming apparatus 1.

As shown in FIG. 1, there are provided operation display section 20 and ADF (Auto Document Feeder) 40 representing an automatic document feeder, on the top surface of the image forming apparatus 1.

The operation display section 20 is equipped with LCD (Liquid Crystal Display) 22, and on a screen of the LCD, there is provided a touch panel (not shown) of a pressure-sensitive type (resistance film pressure type) on which transparent electrodes are arranged in a latticed pattern. This touch panel is arranged to detect XY coordinates of a power point that is pressed by a finger or a touch pen, and to output the detected position signals as operation signals to operation display controller 21 (see FIG. 2) which will be described later.

Further, LCD 22 is arranged to display various operation screens such as established screens of established conditions, the state of images, the state of operations of respective functions and various results of processing, on a screen, in accordance with instructions of display signals inputted from the operation display controller 21.

In addition, the operation display section 20 is equipped with various types of operation buttons (not shown) such as a numeral button, a functional button to switch various settings and operation modes and a start button to instruct a start of operations. The operation display section 20 is constructed to output operation signals inputted by the aforesaid button operations to CPU 11 (see FIG. 2) described later from the operation display controller 21.

The ADF 40 is arranged to convey automatically a document that is placed on document table T1 to a prescribed position one by one.

On the position which is inside the image forming apparatus 1 and is corresponding to the lower part of the ADF 40, there is provided image reading section 30. The image reading section 30 is composed of scanner 32 (see FIG. 2) that is equipped with a platen glass, an image sensor such as CCD (Charge Couple Device) and a light source (all are not shown). The scanner 32 scans a document with light emitted from the light source, then, reads out images on the document through photoelectric conversion of the image formed by CCD based on reflected light coming from the scanning, and acquires document image data. The image reading section 30 is arranged to output document image data thus acquired to reading processor 15 (see FIG. 2) described later, and the document image data are outputted to printer section 50 as image data for printing, after being subjected to various image processing. Incidentally, the structure of the scanner 32 is not limited to those illustrated here, and other structures may also be used provided that the structure can acquire document image data.

Further, inside the image forming apparatus 1, there are provided supply trays 87*a* and 87*b* housing therein recording media supplied respectively to printer section 50 and printer section 50 serving as an image forming section that conducts print processing. In large-capacity tray unit 3 connected to the image forming apparatus 1, there are equally provided supply trays 87*c*, 87*d* and 87*e* housing therein recording media.

In the present embodiment, there are used a transfer sheet serving as a sheet for text on which a text portion of a printed object representing an output object is recorded and a special sheet that is inserted properly in transfer sheets as an obverse cover and a back cover of the printed object and as a divider of "a chapter" and "a paragraph". Each of supply trays 87*a*-87*e* constitutes a transfer sheet supply section housing therein transfer sheets, and each of supply trays 87*a*-87*e* is capable of housing therein, for example, transfer sheets having different types and sizes such as plain paper, packing paper, recycled paper and quality paper by types and sizes. Incidentally, the number of supply trays is not limited to those illustrated here, and the number greater than or smaller than the illustrated one is accepted.

The printer section 50 is an image forming section conducting image forming of an electrophotographic type, which is composed of photoreceptor drum 82 representing an image carrier, charging section that charges the photoreceptor drum, LD (laser Diode) 81 that conducts exposure scanning on the surface of the photoreceptor drum based on image data, developing unit 84 wherein toner adheres to the photoreceptor drum, transfer section 85 wherein a toner image formed on the photoreceptor drum is transferred onto a recording sheet, and fixing unit 86 where the toner image formed on the recording sheet is fixed. Further, the printer section 50 is equipped with various types of rollers 88 such as a supply roller for conveying a recording sheet supplied from supply trays 87*a*-87*e* along prescribed conveyance path (shown with heavy lines in FIG. 1) inside the apparatus, as a conveyance section, and a registration roller, conveyance path switching plate 90 that switches the conveyance path for a recording medium on the half way and reversing section 91 that reverses the recording medium.

Incidentally, though the printer section 50 is made to conduct image forming of an electrophotographic type in the present embodiment, an image forming system of the printer section 50 is not limited to this, and other image forming systems such as an inkjet system, a thermal transfer system and a dot impact system may also be accepted.

Post-processing equipment 2 is equipped with stapler 72 and punch unit 73 as a post-processing section. The stapler 72 is one to conduct staple processing for stapling and binding into a booklet after stacking, temporarily on an unillustrated stacker, transfer sheets and special sheets inserted in the transfer sheets all conveyed from the image forming apparatus 1. The punch unit 73 is one wherein transfer sheets and special sheets inserted in the transfer sheets all conveyed from the image forming apparatus 1 are stopped temporarily in the unit and are subjected to punch processing to make a hole. Incidentally, the post-processing section equipped on post-processing equipment 2 is not limited to stapler 72 and punch unit 73, and other post-processing section may also be provided.

Further, on the post-processing equipment 2 in the present embodiment, there is provided post-inserter (hereinafter referred to as "PI") 95 equipped with two supply trays 95*a* and 95*b* for special sheets each being loaded with special sheets to supply them. PI95 is arranged to insert special sheets in the front and the rear of the transfer sheet on which an image is formed by the image forming apparatus 1 and between the transfer sheets, from supply trays 95*a* and 95*b* accordingly.

In the vicinity of supply ports (not shown) of supply trays 95*a* and 95*b*, there are provided various types of rollers 88 including supply rollers for conveying, as a conveyance section, special sheets supplied from supply trays 95*a* and 95*b*, along the prescribed conveyance path (shown with heavy lines in FIG. 1) in the apparatus.

The special sheet, in this case, is one wherein a plurality of sheets each being different in terms of kinds are arranged in the predetermined order to constitute one set. In the present embodiment, an explanation will be given referring to an example of tab sheets wherein the tab sheets are arranged so that their tab positions are different in sequence from the first sheet.

Tab sheets as special sheets are arranged so that they are housed in supply trays 95*a* and 95*b* as a group of special sheets having sets. One set of the group of special sheets constitutes with the predetermined number of sheets such as 3-sheet set or 5-sheet set based on intended purpose. Meanwhile, the special sheets are not limited to the tab sheets if the special sheets are those wherein a plurality of sheets each being different in terms of kinds are arranged in the predetermined order to constitute one set of a group of special sheets, and for example, they may also be color sheets wherein the sheets are arranged so that their colors are different in sequence from the first sheet to constitute one set.

In the present embodiment, an explanation is given with an example of the occasion wherein tab sheets of one set composed of 3 sheets are housed in supply tray 95*a* serving as the first supply section as the first group of special sheets, and tab sheets of one set composed of 5 sheets are housed in supply tray 95*b* serving as the second supply section as the second group of special sheets. For example, the tab sheets of one set of 3 sheets representing the first group of special sheets are those which are inserted properly between transfer sheets as an obverse cover, a back cover and a divider of "chapter" in the printed object, and the tab sheets of one set of 5 sheets representing the second group of special sheets are those which are inserted properly between the transfer sheets and the tab sheets of one set of 3 sheets representing the first group of special sheets, as dividers of "paragraph".

Next, control construction of image forming apparatus 1 and post-processing equipment 2 which constitute image forming system 100 in the present embodiment will be explained, referring to FIG. 2.

The image forming system 100 is composed of print controller 60 that mediates transmission and receiving of information between an outside equipment and the image forming system 100 and state control section 10 that is equipped with CPU 11 and controls conditions of the image forming system 100.

First, the print controller 60 is composed of I/F 61 and data conversion section 62. The I/F 61 is an interface for communication for connecting to communication network N such as NIC (Network Interface Card) and a modem, and it is one to conduct transmitting and receiving of data with an outside equipment such as host apparatus 200. The data conversion section 62 is arranged to convert printing data inputted through I/F 61 into image data of a data type that can be printed by image forming apparatus 1 through the prescribed page description language, and then, to output the data to DRAM control IC 16 of the condition control section 10 together with control data.

Next, the condition control section 10 is a computer that is composed of CPU 11, program memory 12, RAM (Random Access Memory) 13, nonvolatile memory 14, reading processing section 15, DRAM (Dynamic Random Access Memory) control IC 16, compression/extension IC 17, image memory (DRAM) 18 and writing processing section 19.

The CPU 11 is arranged to conduct central control of operations of respective sections of the image forming apparatus so that various types of processing programs including a system program and an unwanted tab sheets ejection processing program stored in the program memory 12 are read out to be developed on RAM 13, and various types of processing may be practiced based on the developed programs.

The program memory 12 is composed of a nonvolatile memory, for example, of a semiconductor, and it stores various types of processing programs including a system program corresponding to image forming apparatus 1 and an unwanted tab sheet ejection processing program that is practicable on the system program. The program is stored in a form of a program code that can be read by the computer, and CPU 11 conducts operations in accordance with the program code in succession.

The RAM 13 is a memory section serving as a temporary storage area for programs read out by the program memory 12, input data or output data and parameters. For example, the RAM 13 has a job setting information storage area for storing setting information of each job temporarily as stated above.

The CPU 11 recognizes, as an information setting section, setting information for each job that is inputted through operation display section 20, or inputted from outside equipment through print controller 60, and stores it in a job setting storage area of the RAM 13. In the present embodiment, in particular, tab print setting information is inputted from operation display section 20 or from an outside equipment, as setting information of each job. The tab print setting information is arranged so that information of the number of tab sheets included in one set for a group of tab sheets (special sheets) used in output job and information of a type of a tab sheet and a place where the tab sheet of that type is to be inserted, for example, are inputted. The CPU 11 recognizes the number of sheets for tab sheets constituting one set of a group of tab sheets from the inputted information, and stores it in a job setting storage area of the RAM 13 as setting information. Then, CPU 11 carries out output job based on the stored setting information.

The output job in this case means a series of operations relating image forming such as printing, and for example, when copying a plurality of documents, one job corresponds to a series of operations relating to copying of plural sheets of documents, while, when copying a plurality of copies, one job corresponds to a series of operations relating to copying of plural copies.

An unillustrated sensor is provided in the vicinity of supply trays 95*a* and 95*b* each being loaded with tab sheets, and when a tab sheet is supplied from each of the supply trays 95*a* and 95*b*, it is detected by the sensor. The results of the detection by the sensor are transmitted to CPU 11 as sensor signals, and the CPU 11 counts the sensor signals to acquire count information that indicates the number of tab sheets supplied from the supply trays 95*a* and 95*b*.

In the present embodiment, CPU 11 reads out an unwanted tab sheet ejection processing program stored in program memory 12, and carries out to conduct unwanted tab sheet ejection processing shown below.

Namely, before a new tab sheet is inserted from the inside of the set of "the first tab sheet group" representing "the first special sheet group" inserted first in each output job, CPU 11 judges whether unwanted tab sheets are generated in "the second tab sheet group" or not, based on count information indicating the number of tab sheets supplied from "the second tab sheet group" representing "the second special sheet group" which is different in terms of a type from "the fist tab sheet group" and on setting information indicating the number of sheets in one set for "the second tab sheet group".

Specifically, the CPU 11 reads out the number of tab sheets (m1) constituting one set for "the second tab sheet group" that is different in terms of a type from "the first tab sheet group" inserted first, from a job setting storage area of RAM 13, and compares this number of tab sheets with the number of sheets (m2) supplied from "the second tab sheet group" that is counted from the results of the detection by the sensor. As a result of the comparison, in the case of m1 >m2, the number of unwanted tab sheets to be ejected A is calculated by the following expression (1). In the case of m1<m2, the number of unwanted tab sheets to be ejected A is calculated by the following expression (2). However, when m2 is an integral multiple of m1, an expression of A=0 holds. As a result of calculation, if unwanted tab sheets to be ejected are in existence (A≠0), the CPU 11 determines where to eject the unwanted tab sheets. In this case, CPU 11 selects, as where to eject unwanted tab sheet, an ejection tray that is different from an ejection tray serving as a loading section that is ejected together with transfer sheets and respective tab sheets which are stacked on the loading section. Incidentally, in addition to the ejection tray, where to eject unwanted tab sheets may be either an intermediate stacker which is provided in the inside, for example, of image forming apparatus 1 or post-processing equipment, or the unwanted tab sheets may be ejected in a container provided outside the image forming system 100, to be stacked in the container in succession. Pieces of information about the number of unwanted tab sheets and about where to eject unwanted tab sheets are sent from CPU 11 to FNS controller 71 of the post-processing equipment 2 through printer controller 51 which will be described later. The FNS controller 71 controls roller 88 based on information thus sent, and conducts unwanted tab sheet ejection processing that ejects unwanted tab sheets to the prescribed ejection target. In the present embodiment, an explanation will be given referring to an example wherein CPU 11 determines sheet-ejection tray Ta2 as an ejection target for unwanted tab sheets.

$$A=m1-m2 \qquad \text{Expression (1)}$$

$$A=m1-(\text{remainder of } m2 \div m1) \qquad \text{Expression (2)}$$

Figure 3:
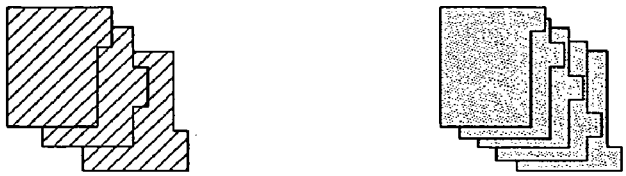
FIG. 3(*a*) is a diagram showing a content of tab sheet sets used in the first embodiment.
Figure 3:
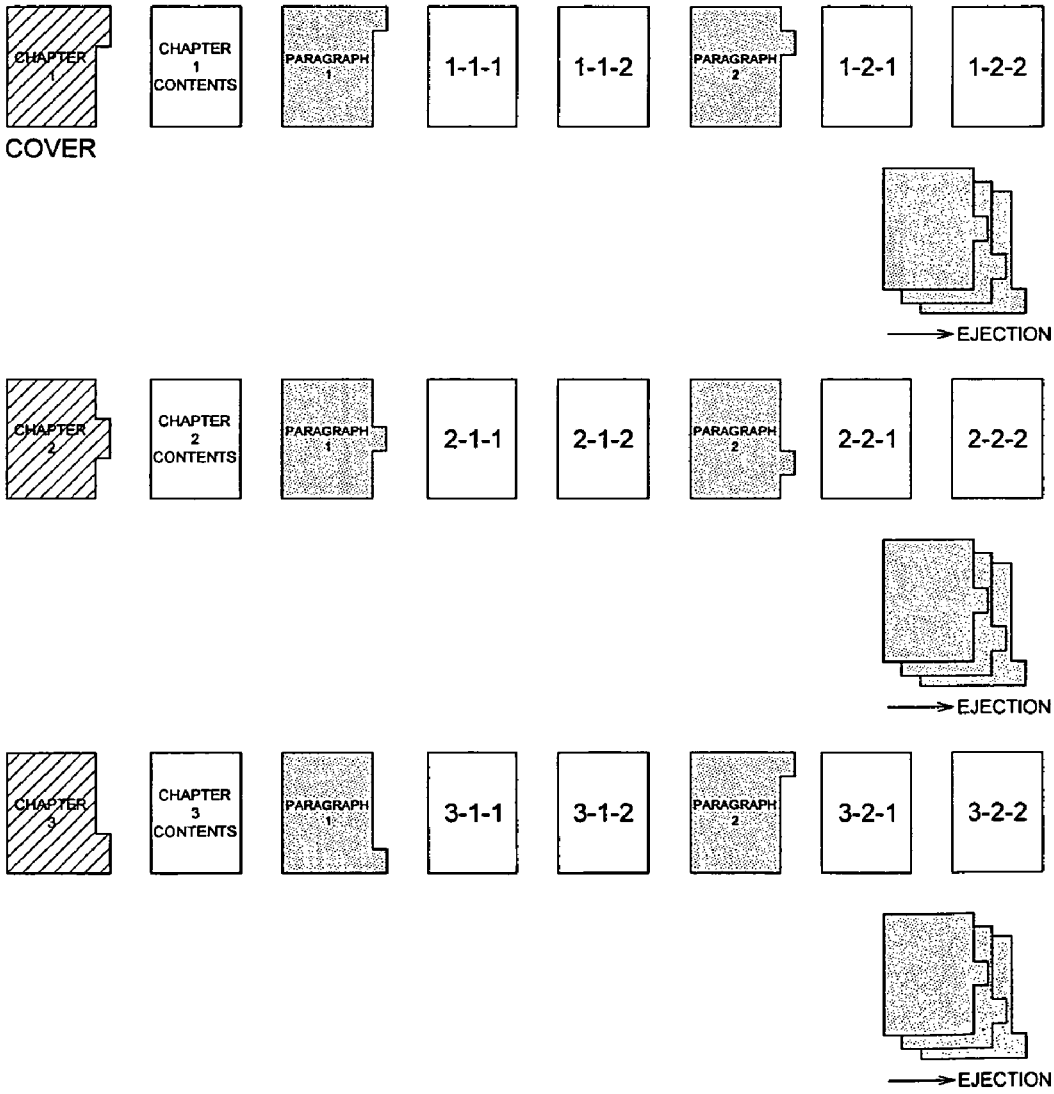
Figure 4:
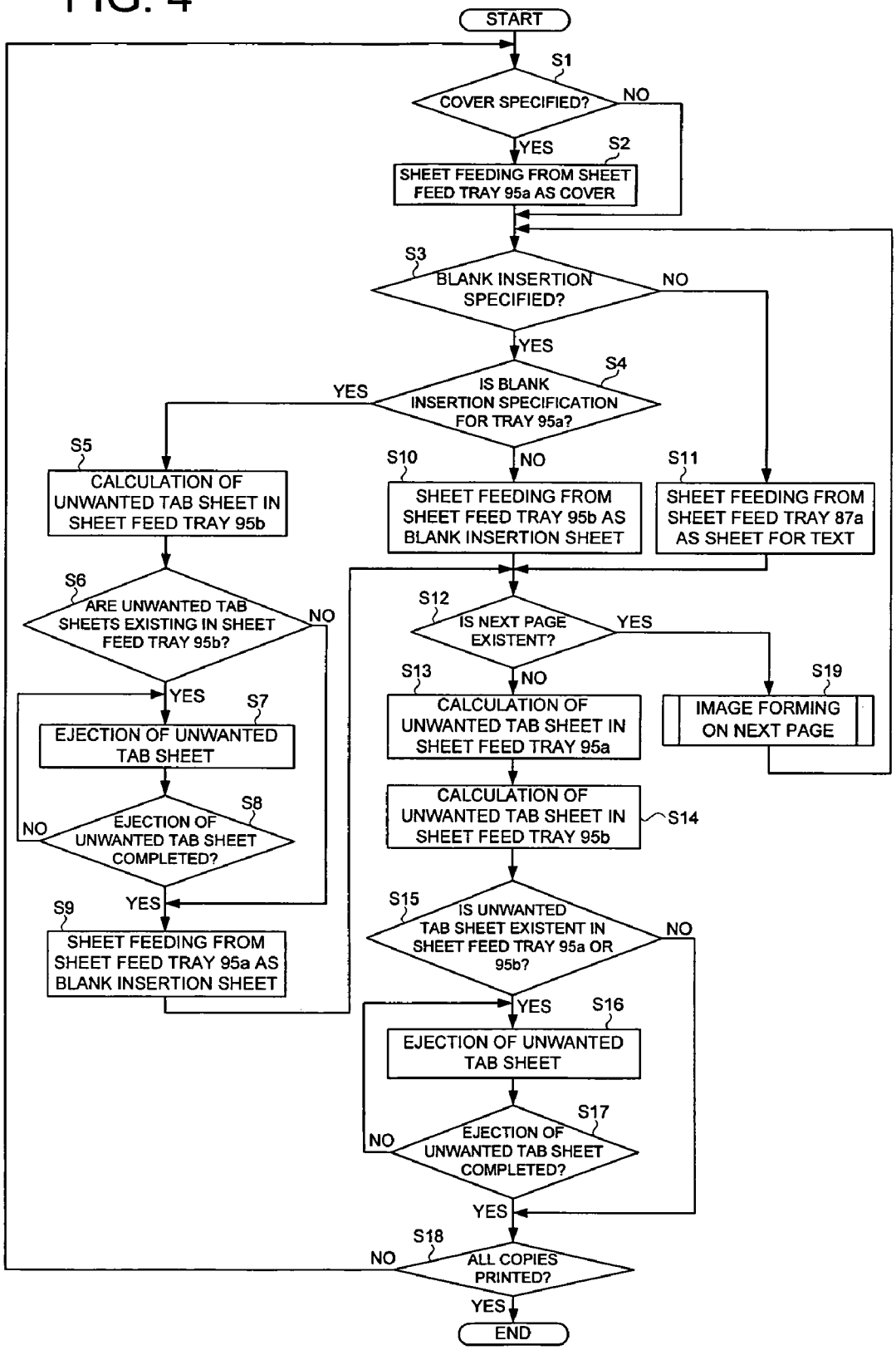
FIG. 4 is a flow chart showing unwanted tab sheet ejection processing practiced by the image forming system relating to the first embodiment.

For example, as shown in FIG. 3(*a*), an explanation will be given concretely referring to an example wherein a printed object is made by using tab sheets of 3-sheet set (composed of three kinds of tab sheets including tab sheet of first tab—tab sheet of third tab, each having a different tab position) loaded in supply tray 95*a* and tab sheets of 5-sheet set (composed of five kinds of tab sheets including tab sheet of first tab—tab sheet of fifth tab, each having a different tab position) loaded in supply tray 95*b*.

In this case, if the insertions of tab sheets for 3-sheet set are established to be "obverse cover/after fifth page/after tenth page", and the insertions of tab sheets for 5-sheet set are established to be "after first page/after third page/after sixth page/after eighth page/after eleventh page/after thirteenth page", a tab sheet group of 3-sheet set becomes "first tab sheet group" to be inserted first in output job, a tab sheet group of 5-sheet set becomes "second tab sheet group", and the number of tab sheets (m1) constituting "second tab sheet group" one set becomes five sheets. Then, in this case, the number of tab sheets (m2) supplied from "the second tab sheet group" during the period from the moment when the first tab sheet is inserted between transfer sheets from the tab sheet group of 3-sheet set representing "the first tab sheet group" up to the moment when the second tab sheet is inserted from "the first tab sheet group", is two sheets, resulting in m1>m2. Therefore, the number of ejected unwanted tab sheets A is calculated from the aforesaid expression (1), resulting in A=3. In the same way, the number of tab sheets (m2) supplied from "the second tab sheet group" during the period from the moment when the second tab sheet is inserted from "the first tab sheet group" up to the moment when the third tab sheet is inserted from "the first tab sheet group", and the number of tab sheets (m2) to be supplied from "the second tab sheet group" during the period from the moment when the third tab sheet is inserted from "the first tab sheet group" up to the moment when printing is terminated, are also calculated respectively, and the number of unwanted tab sheets A to be ejected is calculated, resulting respectively in A=3. Then, where to eject unwanted tab sheets is determined to be sheet-ejection tray Ta2, for example, by CPU 11, pieces of information including the number of unwanted tab sheets (A=3) and sheet-ejection tray Ta2 to which the unwanted tab sheets are ejected are sent from the CPU 11 to FNS controller 71 of post-processing equipment 2 through printer controller 51 which will be described later. The FNS controller 71 controls roller 88 based on the information thus transmitted, and causes three unwanted tab sheets to be ejected to the sheet-ejection tray Ta2.

Next, nonvolatile memory 14 is one to store various types of established data relating to image forming apparatus 1.

Further, reading processor 15 is arranged to convert analog image signals which are read by image reading section 30 into digital image data, and to output them to DRAM control IC 16.

Based on the control from CPU 11, the DRAM control IC 16 controls compression/extension IC 17 so that image data inputted from the reading processor 15 and image data inputted from print controller 60 may be compressed, and writes the compressed image data on compression memory 18*a* of image memory 18 for temporal storage. Further, when instructions for image data output are given by CPU 11, the DRAM control IC 16 controls compression/extension IC 17 so that image data stored in the compression memory 18*a* and instructed to be outputted may be extended, and outputs them to writing processing section 19. writing processing section 19. The DRAM control IC 16 is arranged to output control data inputted from the print controller 60 to CPU 11.

The compression/extension IC 17 is IC to conduct compression processing and extension processing for image data under the control of the DRAM control IC 16.

The image memory 18 is composed of DRAM and has compression memory 18*a*. The compression memory 18*a* stores temporarily the image data compressed by compression/extension IC 17 under the control of the DRAM control IC 16.

Writing processing section 19 generates PWM (Pulse Width Modulation) signals based on image data inputted from compression/extension IC 17, and outputs them to printer section 50.

Further, the CPU 11 of state control section 10 is connected respectively with operation display controller 21 that controls operation display section 20, scanner control section 31 that controls image reading section 30, ADF control section 41 that controls ADF 40 and with printer controller 51 that controls printer section 50. These respective controllers are arranged to control operations of respective portions based on signals from CPU 11. Further, on the post-processing equipment 2, there is provided FNS controller 71 which is arranged to control operations of each section of the post-processing equipment 2 based on signals coming from the printer controller 51. A specific explanation will be given below.

First, operation display controller 21 receives display signals coming from CPU 11 and controls display in LCD 22, and it outputs operation signals inputted from a touch panel on LCD 22 to CPU 11.

In the present embodiment, the operation display section 20 causes, as an input section, LCD 22 to display a tab print setting screen (not shown) to conduct setting relating to a printing job using a tab sheet, and outputs tab print setting information inputted through a tab print setting screen to CPU 11.

Receiving control signals coming from CPU 11, the scanner control section 31 causes a beam from a light source to scan a document, and reads an image of the document by converting photoelectrically a beam that is reflected on the document and forms an image on CCD. Then, the scanner control section 31 outputs analog image signals thus read to reading processor 15.

The ADF control section 41 controls each section of ADF 40 based on control signals inputted from CPU 11, so that a document placed on document tray T1 (see FIG. 2) may be fed one by one automatically onto a platen glass of the image reading section 30.

Figure 2:
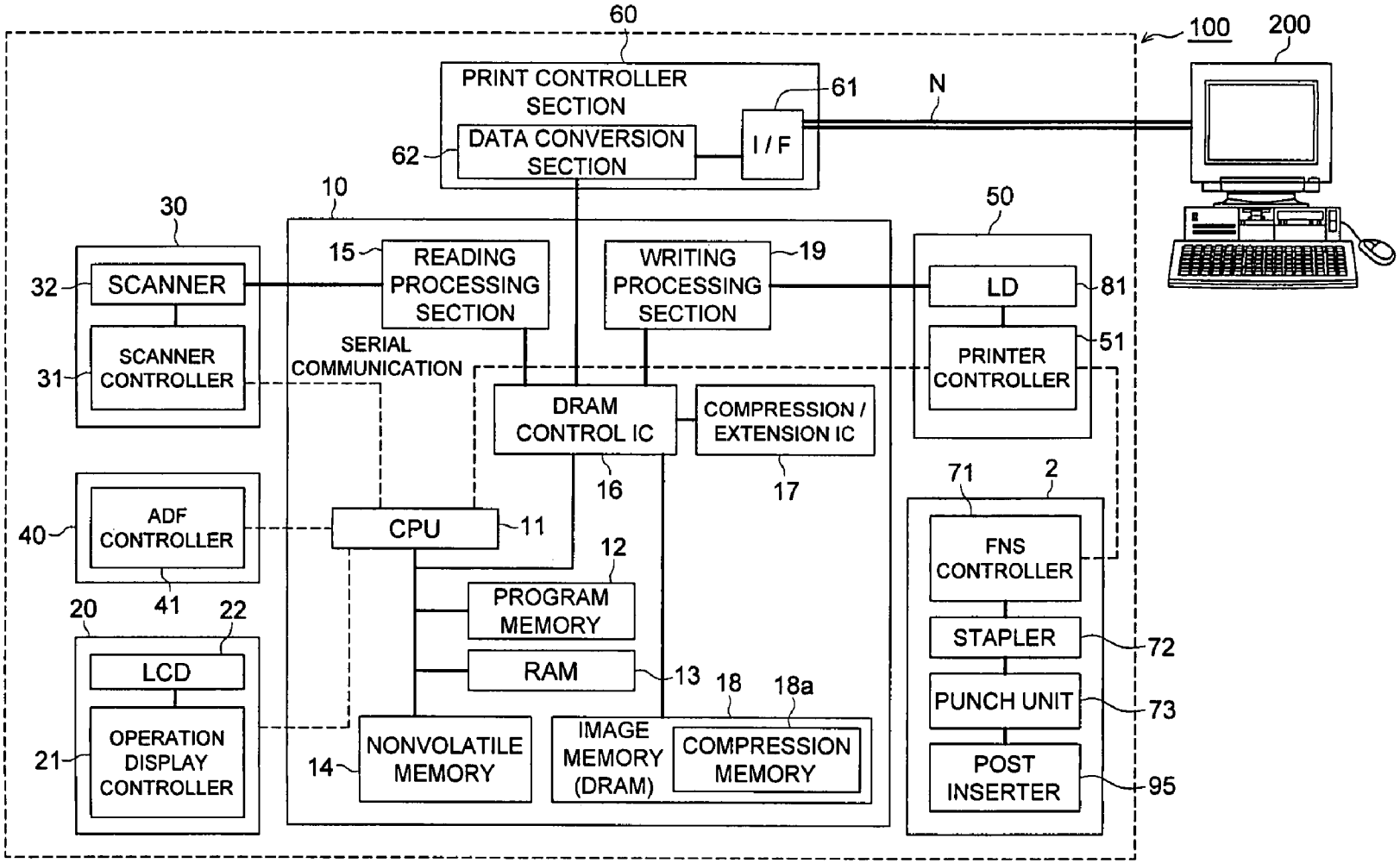
FIG. 2 is a block diagram showing a functional structure of the image forming system in FIG. 1.

The printer section 50 is composed of printer controller 51 and supply trays 87*a*-87*e* which supply transfer sheets, as shown in FIGS. 1 and 2. Based on the control from the printer controller 51, the roller 88 serving as a conveyance section feeds a transfer sheet with a type, a size and an orientation to be used in the job from any one of supply trays 87*a*-87*e* corresponding to that transfer sheet, and further feeds a tab sheet from either one of supply trays 95*a* and 95*b*, so that the transfer sheet or a tab sheet thus fed may be conveyed onto the conveyance path.

Based on instructions by CPU 11, the printer controller 51 causes a surface of photoreceptor drum 82 to be charged by charging section 83, and based on PWM signals inputted from writing processing section 19, a laser beam is irradiated on a surface of photoreceptor drum 82 by LD 81, to form an electrostatic latent image, thus, toner is deposited by developing unit 84 on an area including the electrostatic latent image on the surface of the photoreceptor drum 82. Then, the roller 88 is driven properly to feed a transfer sheet from any one of supply trays 87*a*-87*e*, and further, a tab sheet is supplied from either one of feed trays 95*a* and 95*b*, and a transfer sheet or a tab sheet is conveyed along a prescribed conveyance path, thus, toner is transferred by transfer section 85 onto the transfer sheet or the tab sheet thus conveyed to form an image which is fixed by fixing unit 86. After that, the transfer sheet on which an image has been formed is sent out to post-processing equipment 2 by roller 88 in sequence. When conducting two-sided printing, the transfer sheet on which an image has been printed on its one side or a tab sheet is conveyed to conveyance path switching plate 90, and is conveyed to reversing section 91 through a reversing path, thereby, the sheet is reversed in terms of the obverse and reverse by reversing section 91 to be conveyed again to photoreceptor drum 82 where an image is formed on the obverse side after reversing, and the sheet is sent out to post-processing equipment 2 by ejection roller 94 after fixing.

Further, printer controller 51 controls operations of each section of printer section 50 based on instructions of CPU 11, and relays data communication between CPU 11 and FNS controller 71.

The FNS controller 71 provided on the post-processing equipment 2 is arranged to conduct each section of the post-processing equipment 2 based on control signals inputted from CPU 11 through the printer controller 51. The FNS controller 71 is composed of CPU, a system program corresponding to post-processing equipment 2, a program memory that stores various types of processing programs practicable on the system program and RAM (all of them are not shown), and CPU of the FNS controller 71 conducts drive control for each section based on inputted control signals, through cooperation with the program stored in the program memory, conveys a transfer sheet or a tab sheet ejected from printer section 50 by a conveyance section composed of unillustrated rollers, along the prescribed conveyance path, conducts post-processing such as staple processing, saddle stitch processing and center-folding processing by accumulating sheets for each portion on a loading section such as an unillustrated intermediate stacker and ejects the sheets to an indicated ejection tray (either one of first ejection tray Ta1 and second ejection tray Ta2). Further, in the present embodiment, PI 95 is operated based on control signals inputted from CPU 11 through printer controller 51 to eject unwanted tab sheets an indicated ejection tray.

Incidentally, CPU 11 is connected with scanner control section 31, ADF control section 41, operation display controller 21 and with printer controller 51 through serial communication, while, printer controller 51 is connected with FNS controller 71 through serial communication, thus, various types of information are transmitted or received in a form of serial data. Meanwhile, a communication style between CPU 11 and respective control sections and a communication style between printer controller 51 and FNS controller 71 may also be a communication method other than that of serial communication.

Next, operations of an image forming system in the present embodiment will be explained.

When input of information to be set such as the number of sets concerning print processing, the presence or absence of designation for insertion of a cover, a position of insertion in the case of inserting a tab sheet as a blank sheet, the number of tab sheets constituting one set of tab sheet group to be used, a type and a size of a transfer sheet to be subjected to recording, and the presence or absence and types of post-processing and input of designation for the start of print processing, are conducted from outside equipment such as host device 200 and from operation display section 20, information to be set thus inputted is sent to CPU 11 of state control section 10, and print processing is started.

Namely, when ADF control section 41 receives instructions from CPU 11 to operate ADF 40 so that documents are supplied automatically onto a platen glass of image reading section 30 sequentially, and when scanner control section 31 operates scanner 32, documents are read out and data of images thus read out are outputted to reading processor 15. Image data thus read out are outputted to writing processing section 19, and when printer controller 51 operates LD 81 based on the aforesaid image data, an image is formed on a transfer sheet. Further, an obverse cover and a tab sheet as a blank sheet are inserted properly into transfer sheets conveyed by a conveyance section. After entire completion of printing for one copy, the aforesaid copy is sent to a post-processing equipment as one set, and staple processing is carried out for each set, based on instruction signals sent from CPU 11 through print control section 2.

In the present embodiment, the existence or absence of unwanted tab sheets is judged before print processing for the subsequent chapter is started after termination of print processing for each chapter, and when unwanted tab sheets exist, unwanted tab sheet ejection processing is carried out to eject the unwanted tab sheets. The unwanted tab sheet ejection processing will be explained as follows, referring to FIG. 4. This processing is realized by software processing that is carried out by cooperation between CPU 11 and an unwanted tab sheet ejection processing program stored in program memory 12.

First, in the case of existence of instructions for insertion of an obverse cover (step S1; YES) after judgment of the existence or absence of instructions for insertion of an obverse cover (step S1), the first tab sheet of a tab sheet group of 3-sheet set loaded in supply tray 95*a* as an obverse cover is inserted (Step S2). After the obverse cover is inserted, or when the insertion of an obverse cover is not instructed (step S1; NO), the presence or absence of instructions for inserting a tab sheet as a blank sheet is judged (step S3). When the instructions for inserting a blank sheet exist (step S3; YES), there is judged whether the tab sheet that is instructed to be inserted is loaded in the supply tray 95*a* or not (step S4). When the tab sheet loaded in the supply tray 95*a* is instructed to be inserted (step S4; YES), the number of unwanted tab sheets in supply tray 95*b* is calculated (step S5). Then, the existence or absence of unwanted tab sheets is judged from the results of the calculation (step S6), and when the unwanted tab sheets are judged to exist (step S6; YES), unwanted tab sheets in quantity equivalent to the number calculated are ejected to the sheet-ejection tray (step S7). Then, there is judged whether all of the unwanted tab sheets are ejected or not (step S8), and when the ejection is completed (step S8; YES) and when unwanted tab sheets are judged not to exist in supply tray 95*b* (step S6; NO), the second tab sheet of a tab sheet group of 3-sheet set is supplied from supply tray 95*a* as a blank sheet and is inserted between the transfer sheets (step S9). When the ejection of unwanted tab sheets is not completed (step S8; NO), a step returns to step S7 to conduct ejection of tab sheets. On the other hand, when the tab sheets instructed to be inserted are not those loaded in supply tray 95*a* (step S4; NO), a tab sheet is inserted from supply tray 95*b* (step S10). When there is no instruction for insertion of a blank sheet (step S3; NO), a transfer sheet is supplied from any one of supply trays 87*a*-87*e* as a sheet for the text on which the text of a printed object is printed (step S11).

After tab sheets are supplied from supply trays 95*a* and 95*b*, or after a transfer sheet is supplied from any one of supply trays 87*a*-87*e*, there is judged whether a subsequent page exit or not (step S12). When the subsequent page exists (step S12; YES), a step returns to step S3 to repeat the aforesaid processing after the image forming processing for the subsequent page is conducted (step S19). When the subsequent page does not exist (step S12; NO), the number of unwanted tab sheets in supply tray 95*a* and that of unwanted tab sheets in supply tray 95*b* are calculated (step S13, step S14). Then, the existence or absence of unwanted tab sheets is judged from the results of the calculations (step S15), and when unwanted tab sheets are judged to exist (step S15; YES), unwanted tab sheets in quantity equivalent to the number calculated are ejected (step S16). Then, there is judged whether all of the unwanted tab sheets are ejected or not (step S17), and when ejection of unwanted tab sheets is not completed (step S17; no), a step returns again to step S7 to eject tab sheets. When the ejection is completed (step S17; YES), if unwanted tab sheets are judged not to be loaded in supply trays 95*a* and 95*b* (step S15; no), there is judged whether the printing for the number of sets expected further as a printing job are all completed or not (step S18). When printing for all sets is completed (step S18; YES), that output job is terminated, while, when printing for all sets is not completed (step S18; NO), a step returns to step S1 to repeat the aforesaid respective processing until the printing for all sets is completed.

In the present embodiment, when the first tab sheet is inserted to be ahead of a transfer sheet (sheet for text) constituting a printed object, the tab sheet is set to be inserted as an obverse cover. However, when it is possible to set so that a blank insertion sheet is inserted to be ahead of the transfer sheet (sheet for text), it is also possible to employ the structure wherein step S1 and step S2 [each judging the presence or absence of] do not exist, and processing flow starts from step S3 where the existence or absence of designation for inserting a blank sheet is judged.

As stated above, the presence or absence of excessive tab sheets are judged regarding the second tab sheet group inserted between the first tab sheet group, before a new tab sheet is supplied from the first tab sheet group which has been used first in print processing for each set, and the excessive tab sheets are ejected accordingly, in the present embodiment. Owing to this, when inserting a tab sheet in each end of "chapter" and each end of "paragraph", for example, it is possible to arrange so that the first tab sheet of a tab sheet group for dividing "paragraph" may come not only to the forefront of each copy but also to the forefront of each chapter.

Meanwhile, the present embodiment is arranged to reset tab sheets for dividing each paragraph for each chapter end, and to conduct ejection processing for unwanted tab sheets so that the first tab sheet of a tab sheet group for dividing "paragraph" may come also to the forefront of each chapter. However, it is also possible to arrange so that the presence or absence of unwanted tab sheets is judged by CPU 11 for plural types of tab sheets each time an output job is completed for one copy, for example, and when unwanted tab sheets exist, roller 88 representing a conveyance section can be controlled to supply the unwanted tab sheets from the supply trays 95*a* and 95*b* to eject them to the prescribed target for ejection.

Figure 5:
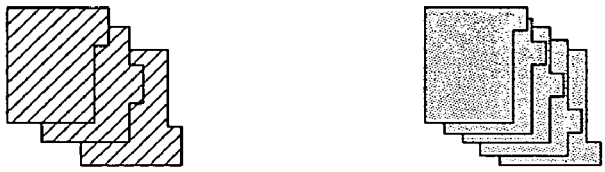
FIG. 5(*a*) is a diagram showing a content of tab sheet sets used in the first embodiment.
Figure 5:
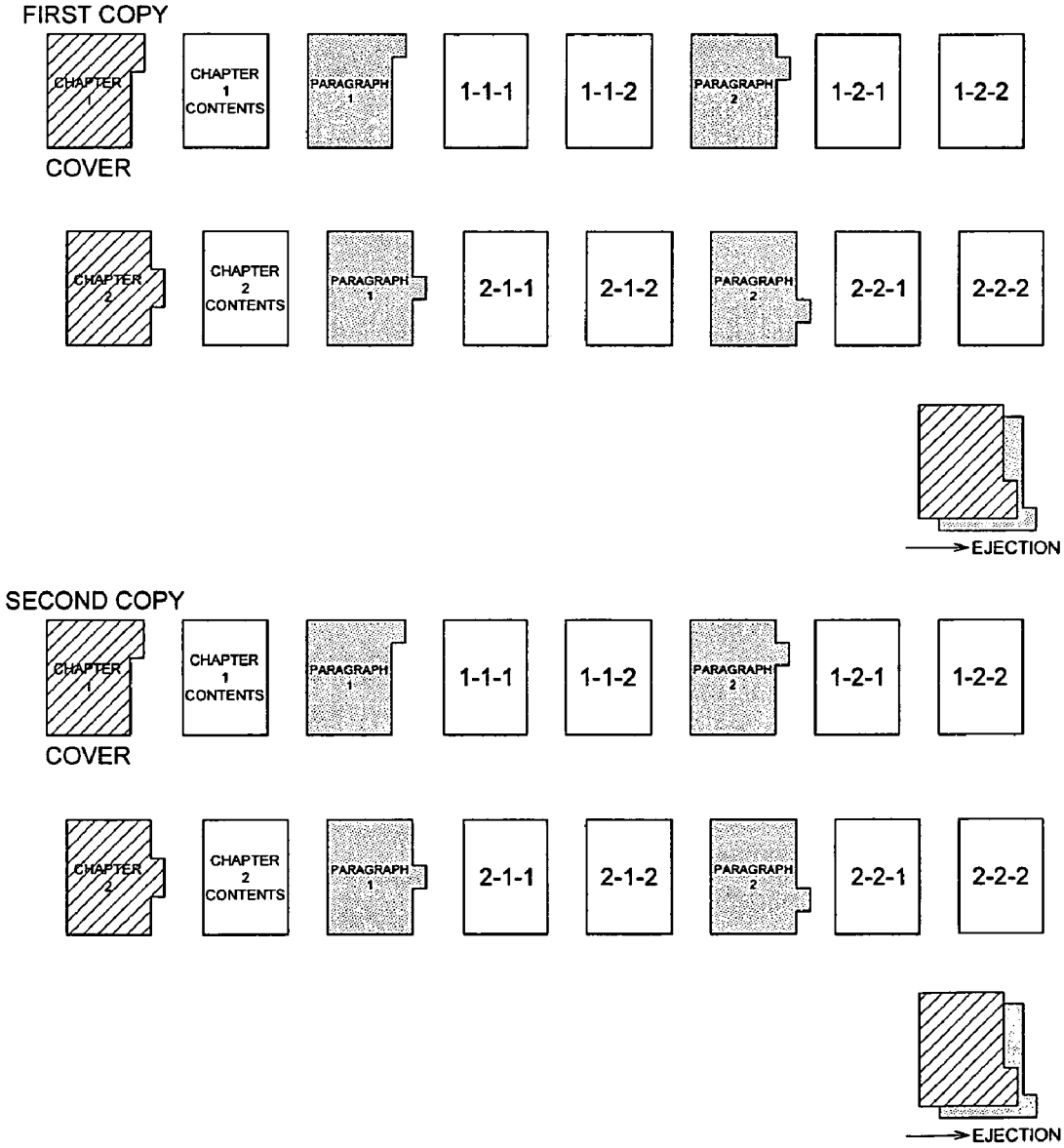

For example, as shown in FIG. 5(*a*), there will be explained an occasion to conduct double-printing wherein tab sheets of 3-sheet set loaded in supply tray 95*a* (composed of three kinds of tab sheets including tab sheet of the first tab—tab sheet of the third tab each having a different tab position) and tab sheets of 5-sheet set loaded in supply tray 95*b* (composed of five kinds of tab sheets including tab sheet of the first tab—tab sheet of the fifth tab each having a different tab position).

Even in this case, an expression for calculating the number of unwanted tab sheets to be ejected A is the same as the expression 1 and the expression 2. A tab sheet group of 3-sheet set becomes "first tab sheet group" inserted first in the output job, and the number of tab sheets (m1) constituting one set of "first tab sheet group" is three sheets. The number of tab sheets (m1) constituting one set of "second tab sheet group" inserted between "first tab sheet group" is five sheets. In this case, the number of tab sheets (m2) to be supplied from "the first tab sheet group" during the period from the moment when the first tab sheet is inserted between transfer sheets from the tab sheet group of 3-sheet set representing "the first tab sheet group" up to completion of output job for one copy, is two sheets, and m1>m2 holds. Then, the number of unwanted tab sheets to be ejected A is calculated by the expression (1), resulting in A=1. The number of tab sheets (m2) to be supplied from "the second tab sheet group" which are inserted between "the first tab sheet group" is four sheets, and m1>m2 holds. Then, the number of unwanted tab sheets to be ejected A is calculated by the expression (1), resulting in A=1. For the second copy, the number of tab sheets in each tab sheet group is calculated in the same way for each completion of output job for one copy. Then, if CPU 11 determines a target for sheet ejection to which the unwanted tab sheet, for example, should be ejected to be sheet ejection tray Ta2, information of the number of unwanted tab sheets (A=1) of tab sheet group of 3-sheet set, information of the number of unwanted tab sheets (A=1) of tab sheet group of 5-sheet set, and information of sheet-ejection tray Ta2 to which unwanted tab sheets are ejected, are sent to FNS controller 71 of image forming apparatus 2 through printer controller 51 which will be explained later. The FNS controller 71 controls roller 88 based on information thus sent, so that unwanted tab sheets in each tab sheet group may be ejected respectively to sheet-ejection tray Ta2 one by one.

Figure 6:
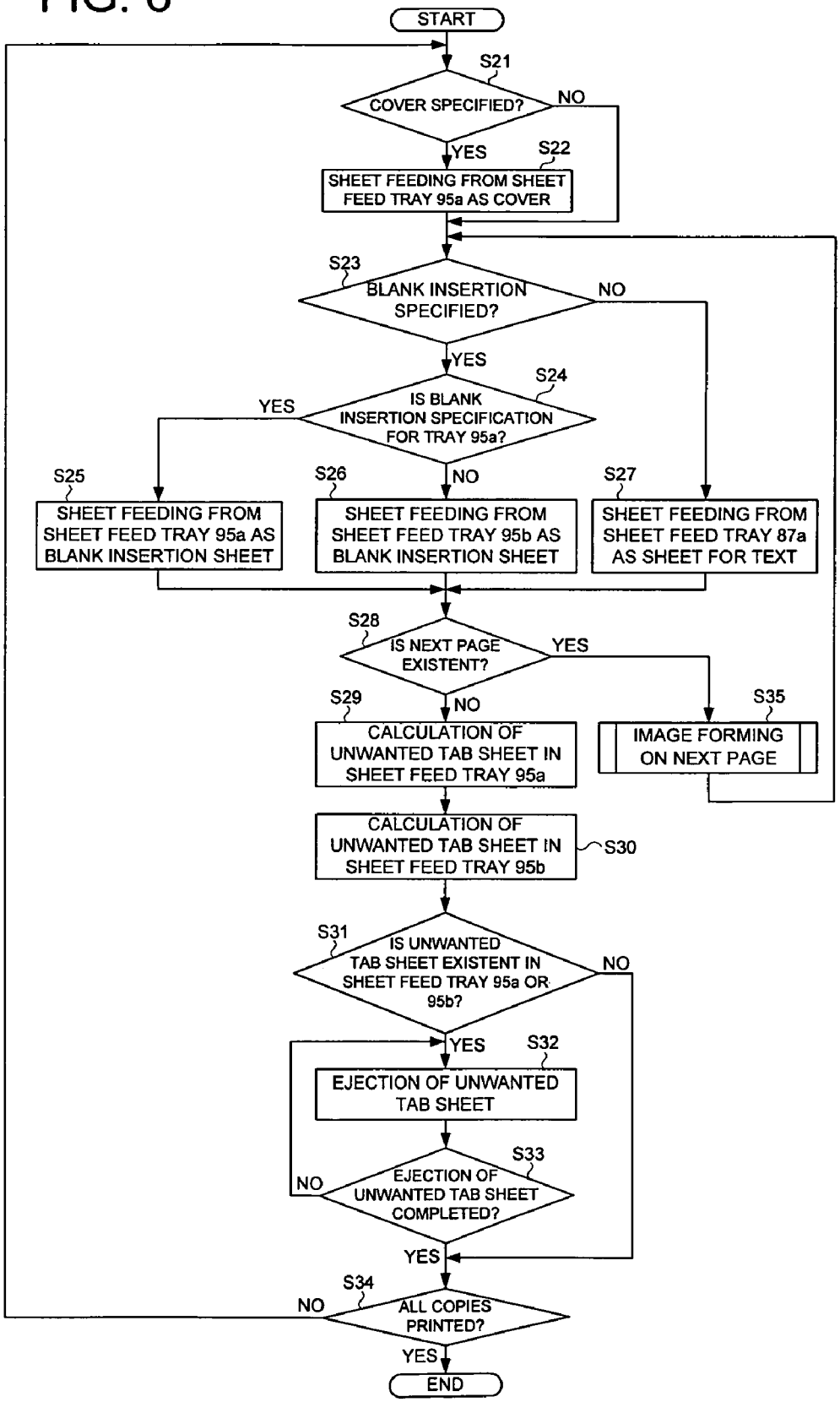
FIG. 6 is a flow chart showing unwanted tab sheet ejection processing practiced by the image forming system relating to the first embodiment.

Unwanted tab sheet ejection processing in this case will be explained in detail, referring to FIG. 6.

First, in the case of existence of instructions for insertion of an obverse cover (step S21; YES) after judgment of the existence or absence of instructions for insertion of an obverse cover (step S21), the first tab sheet of a tab sheet group of 3-sheet set loaded in supply tray 95*a* as an obverse cover is inserted (Step S22). After the obverse cover is inserted, or when the insertion of an obverse cover is not instructed (step S21; NO), the presence or absence of instructions for inserting a tab sheet as a blank sheet is judged (step S23). When the instructions for inserting a blank sheet exist (step S23; YES), there is judged whether the tab sheet that is instructed to be inserted is loaded in the supply tray 95*a* or not (step S24). When the tab sheet loaded in the supply tray 95*a* is instructed to be inserted (step S24; YES), the second tab sheet of a tab sheet group of 3-sheet set is supplied as a blank sheet from supply tray 95*a*, and is inserted between transfer sheets (step S25). On the other hand, when the tab sheet instructed to be inserted is not one loaded in the supply tray 95*a* (step S24; NO), a tab sheet is inserted from supply tray 95*b* (step S26). When there is no instruction for insertion of a blank sheet (step S23; NO), a transfer sheet is supplied from any one of supply trays 87*a*-87*e* as a sheet for the text on which the text of a printed object is printed (step S27).

After tab sheets are supplied from supply trays 95*a* and 95*b*, or after a transfer sheet is supplied from any one of supply trays 87*a*-87*e*, there is judged whether a subsequent page exit or not (step S28). When the subsequent page exists (step S28; YES), a step returns to step S23 to repeat the aforesaid processing after the image forming processing for the subsequent page is conducted (step S35). When the subsequent page does not exist (step S28; NO), the number of unwanted tab sheets in supply tray 95*a* and that of unwanted tab sheets in supply tray 95*b* are calculated (step S29, step S30). Then, the existence or absence of unwanted tab sheets is judged from the results of the calculations (step S31), and when unwanted tab sheets are judged to exist (step S31; YES), unwanted tab sheets in quantity equivalent to the number calculated are ejected (step S32). Then, there is judged whether all of the unwanted tab sheets are ejected or not (step S33), and when ejection of unwanted tab sheets is not completed (step S33; no), a step returns again to step S32 to eject tab sheets. When the ejection is completed (step S33; YES), if unwanted tab sheets are judged not to be loaded in supply trays 95*a* and 95*b* (step S31; no), there is judged whether the printing for the number of sets expected further as a printing job are all completed or not (step S34). When printing for all sets is completed (step S34; YES), that output job is terminated, while, when printing for all sets is not completed (step S34; NO), a step returns to step S21 to repeat the aforesaid respective processing until the printing for all sets is completed.

When ejection processing for unwanted tab sheets is conducted in the aforesaid way, if it is not necessary to reset tab sheets for dividing "paragraph" for each chapter, tab sheets for dividing "paragraph" are not ejected until the completion of printing for one copy, which can realize resource saving by making the number of ejected tab sheets to be minimum.

In addition, in this case, CPU 11 can be made capable of controlling the ejection processing for unwanted tab sheets so that the first tab sheet of a tab sheet group for dividing "paragraph" may come also to the forefront of each chapter, and thereby, of selecting the timing of ejection for unwanted tab sheets. When the timing of ejection for unwanted tab sheets is made to be selectable as in the foregoing, host apparatus 200 or operation display section 20, for example, functions as a selection section to select the ejection timing.

Further, in the present embodiment, unwanted tab sheet ejection processing programs are stored in program memory 12 (see FIG. 2) of image forming apparatus 1, and CPU 11 functions, in cooperation with these programs, as a control section to practice various types of processing including unwanted tab sheet ejection processing and printing processing, while, conveyance processing programs are stored in a program memory of FNS controller 71, and CPU of the FNS controller 71 practices conveyance processing in cooperation with these programs, and based on instructions for ejection and setting information from image forming apparatus 1, the CPU conveys a transfer sheet fed out of the image forming apparatus 1 or tab sheets loaded on supply trays 95*a* and 95*b* of P195 (see FIGS. 1 and 2), along the conveyance path instructed by controlling a conveyance section such as conveyance roller 88, to eject to the instructed target for ejection (ejection tray Ta1, ejection tray Ta2), which is not limited to the occasion where the program for unwanted tab sheet ejection processing is practiced by CPU 11 of the image forming apparatus 1.

For example, it is also possible to arrange so that a program memory of FNS controller 71 stores an unwanted tab sheet ejection processing program in addition to the conveyance processing program, and CPU of the FNS controller 71 practices conveyance processing and unwanted tab sheet ejection processing in cooperation with these programs. In this case, when information about the number of tab sheets for one set of a tab sheet (special sheet) group used in output job is inputted from an outside equipment such as operation display section 20 or host apparatus 200, as a tab printing setting information, the CPU of the FNS controller 71 recognizes the number of tab sheets constituting one set of the tab sheet group from the information thus inputted, and it functions as a section for setting information stored in the program memory as setting information. It is further arranged so that sensor signals of a sensor that detects whether tab sheets are supplied from supply trays 95*a* and 95*b* or not are sent to CPU of FNS controller 71 which counts the sensor signals to acquire the count information showing how many tab sheets are supplied form the supply trays 95*a* and 95*b*.

Incidentally, in the present embodiment, judgments are made whether excessive tab sheets exist or not about tab sheet groups other than the first tab sheet group, before a new tab sheet is supplied from the first tab sheet group used in the first of printing processing for each copy, to eject unwanted tab sheets, in which, however, the timing to judge whether excessive tab sheets exist or not and to eject unwanted tab sheets is not limited to the timing exemplified here. For example, when a position for inserting tab sheets and the number of the tab sheets are inputted in advance from outside equipment such as operation display section 20 or host apparatus 200, and they are established by a control section such as CPU 11, unwanted tab sheets may also be ejected at the point of time when they are generated.

For example, as shown in FIG. 3(*b*), when preparing a booklet wherein two "paragraphs" divided by a tab sheet of "the second tab sheet group" other than the first tab sheet group exist in one "chapter" divided by a tab sheet of "the first tab sheet group", three sheets of unwanted tab sheets are generated at the point of time when the tab sheet of the second paragraph is inserted, thereby, three sheets of unwanted tab sheets generated concerning "the second tab sheet group" may be ejected at this point of time. Further, since the ejection of unwanted tab sheets has only to be finished before an end of the first "paragraph" in the consequent "chapter" comes, the timing for ejecting unwanted tab sheets may be within a period from insertion of a tab sheet dividing the subsequent "chapter" up to insertion of a divider for the first "paragraph" in the aforesaid "chapter".

Though there has been explained an occasion wherein two types of tab sheets including one for dividing "chapter" and the other one for dividing "paragraph" are used for printing processing, in the present embodiment, the present invention can be applied to occasions wherein more types of tab sheets are used for printing processing. In this case, it is also possible to arrange so that the aforesaid relationship between "the first tab sheet" and "the second tab sheet" may hold mutually for all types of tab sheets which are inserted in printed objects (booklets).

Namely, for example, when preparing a printed object by using three types of tab sheets including tab sheet A (for example, tab sheet for dividing "chapter"), tab sheet B to be inserted between tab sheets A (for example, tab sheet for dividing "paragraph") and tab sheet C to be inserted between tab sheets B (for example, tab sheet for dividing "small term"), tab sheet A is "the first tab sheet" and tab sheet B is "the second tab sheet" in the relationship between tab sheet A and tab sheet B, while, tab sheet B is "the first tab sheet" and tab sheet C is "the second tab sheet" in the relationship between tab sheet B and tab sheet C.

The invention is not limited to the present disclosed embodiment, and it is naturally possible to vary the embodiment without departing from the spirit and scope of the invention.

Next, an embodiment of an image forming apparatus relating to the invention will be explained as the second embodiment, referring to FIGS. 7 and 8. Meanwhile, the image forming apparatus in the present embodiment is substantially the same in terms of structure as the image forming apparatus applied to the image forming system shown in the first embodiment. Therefore, some points of the present embodiment which are especially different from those in the first embodiment will be explained as follows.

Figure 7:
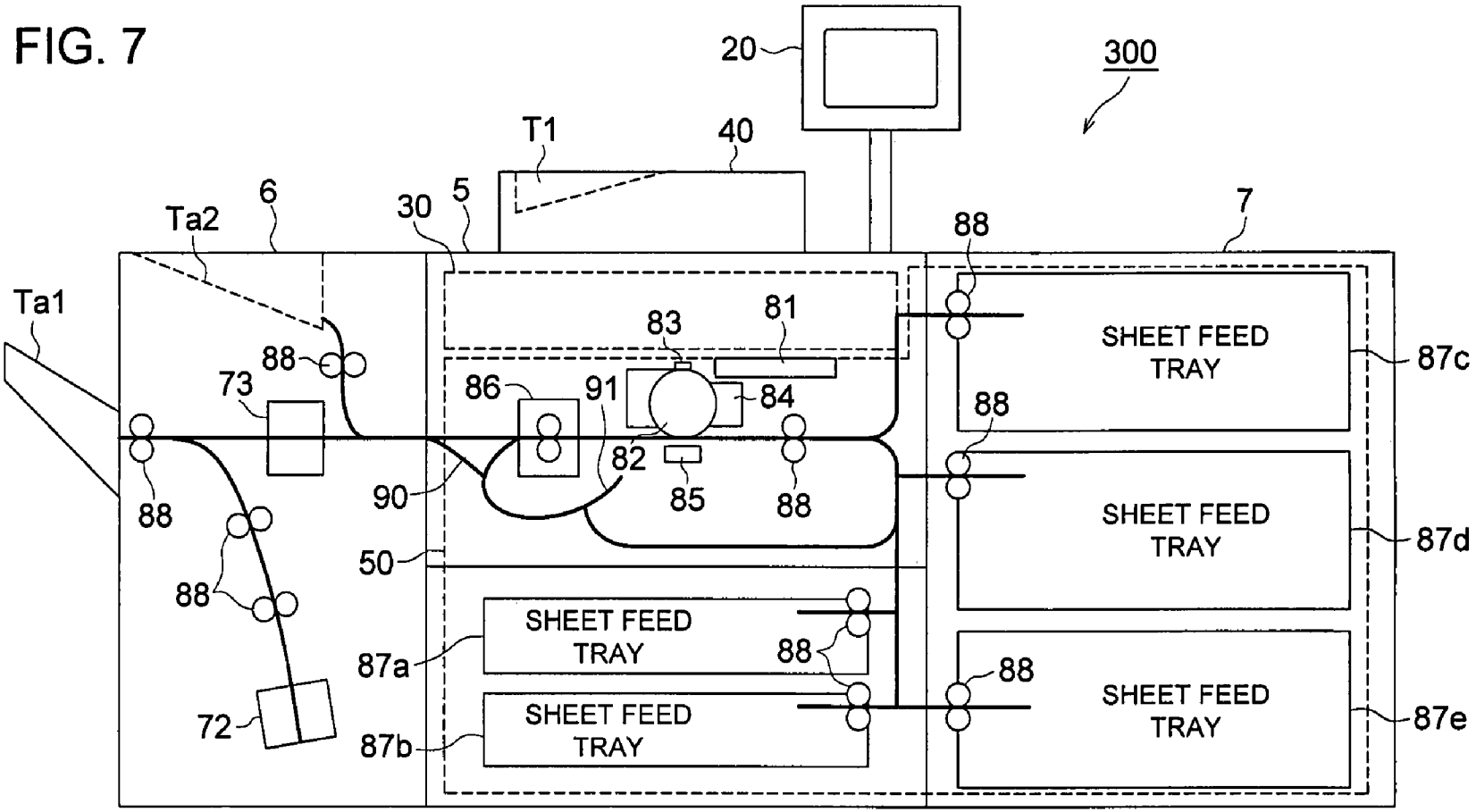
FIG. 7 is a schematic diagram showing an appearance structure and an internal structure of one embodiment of an image forming system relating to the invention.

As shown in FIG. 7, image forming apparatus 300 is composed of image forming apparatus main body (hereinafter referred to simply as "main body") 5 that forms an image on a recording medium such as a transfer sheet, post-processing section (FNS; finisher) 6 that gives post-processing to a recording medium on which an image is formed by the main body and large capacity tray unit 7 which can load a large amount of recording media in an image forming apparatus of the present embodiment. Incidentally, post-processing section 6 and large capacity tray unit 7 are those to be connected to the main body 5 optionally, and it is also possible to arrange so that these items are not provided if necessary.

In the same way as in the image forming apparatus shown in the first embodiment, the main body 5 is equipped with operation display section 20, image reading section 30 and printer section 50, and is equipped with plural rollers 88 representing a conveyance section that conveys recording media from supply trays 87*a* and 87*b*, and from supply trays 87*c*, 87*d* and 87*e* of the supply trays 87*a* and 87*b* as well as a large capacity tray unit 7. Further, in the same way as in the image forming apparatus shown in the first embodiment, post-processing section 6 is equipped with a stapler and punch unit 73. Further, as shown in FIG. 8, the image forming apparatus 300 is equipped with print controller section 60 that mediates transmission and receiving of signals between itself and host apparatus 200 representing an outside equipment.

In the same way as in the image forming apparatus shown in the first embodiment, a transfer sheet on which a text portion of a printed object is recorded and special sheet to be inserted properly between transfer sheets as a divider for "chapter" and "paragraph", are used as recording media, in the present embodiment. Incidentally, in the present embodiment, an explanation will be given as follows, referring to an example of the occasion wherein a tab sheet group of 3-sheet set ("the first tab sheet" as "the first special sheet group") and a tab sheet group of 5-sheet set ("the second tab sheet" as "the second special sheet group") are used as a special sheet, in the same way as in the first embodiment. Further, in the present embodiment, an explanation will be given, referring to an example of the occasion wherein tab sheets of 3-sheet set are loaded in supply tray 87*a* and tab sheets of 5-sheet set are loaded in supply tray 87*b*, to constitute a special sheet supply section, for example, transfer sheets are loaded in any one of 87*c*-87*e* to constitute a transfer sheet supply section.

Figure 8:
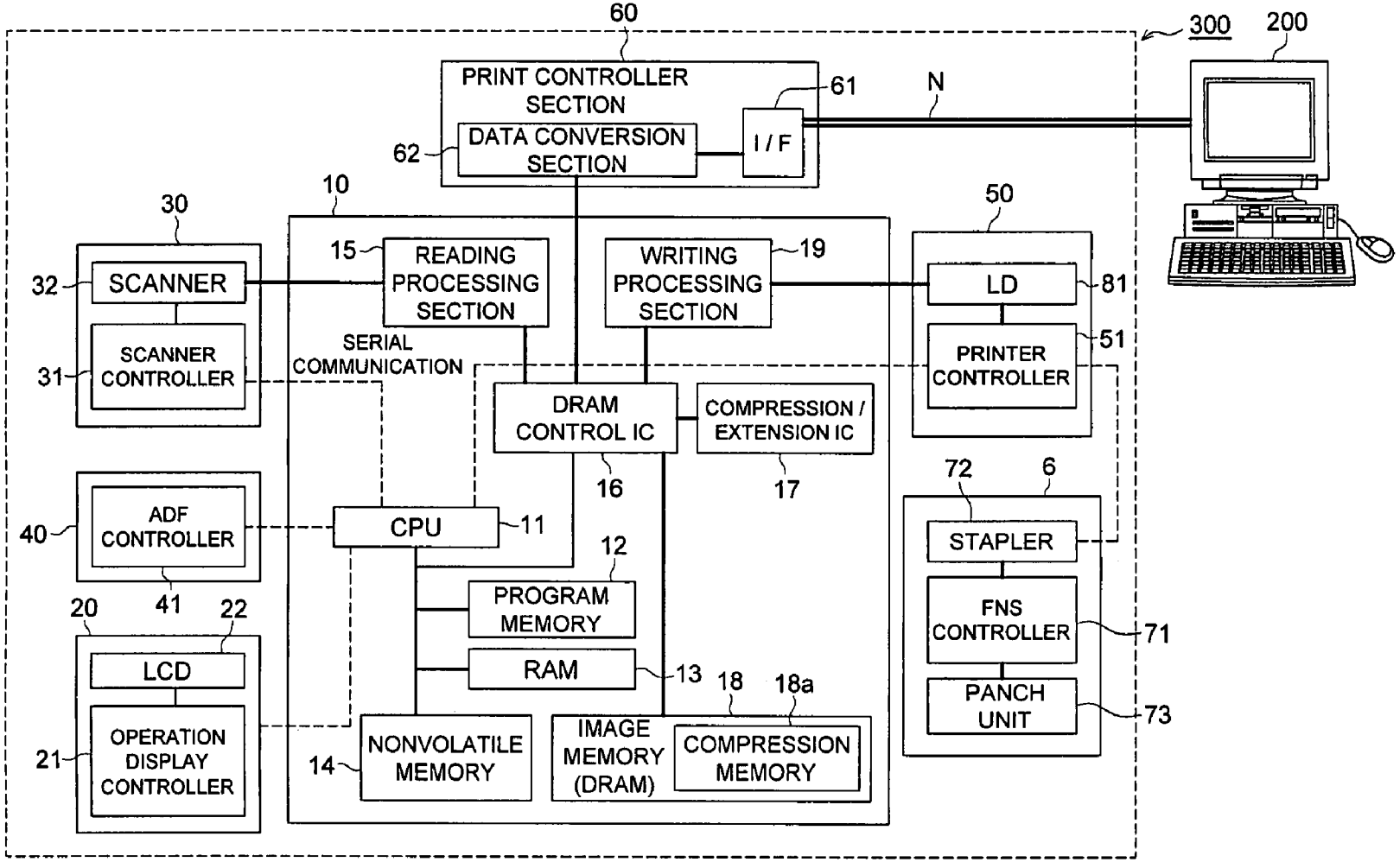
FIG. 8 is a block diagram showing a functional structure of the image forming system in FIG. 1.
Figure 9:
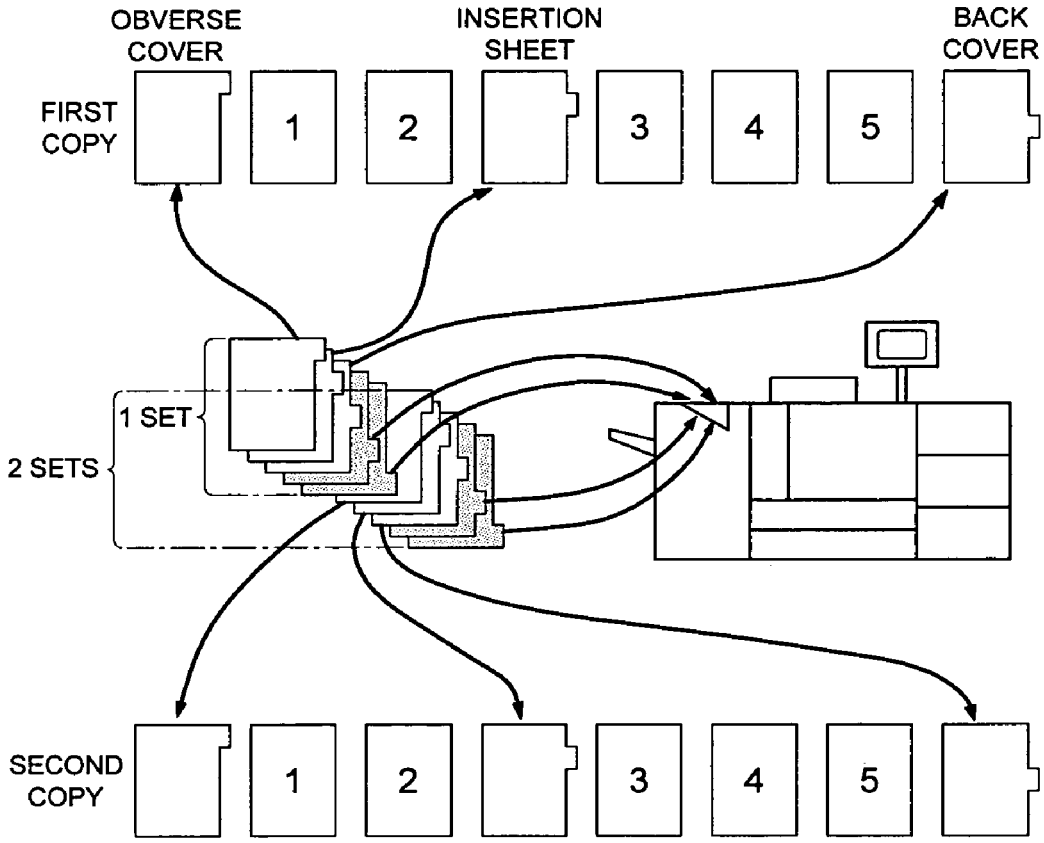
FIG. 9 is a diagram for illustrating a process to eject unwanted tab sheets in a conventional technology.
Figure 10:
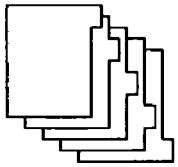
FIG. 10(*a*) is a diagram showing a content of a tab sheet set used in illustrating a conventional technology.
Figure 10:
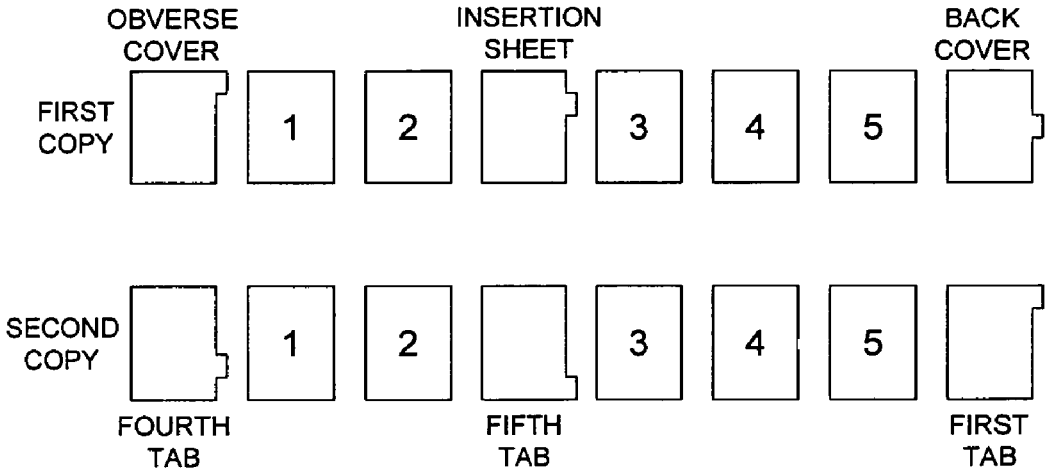
Figure 11:
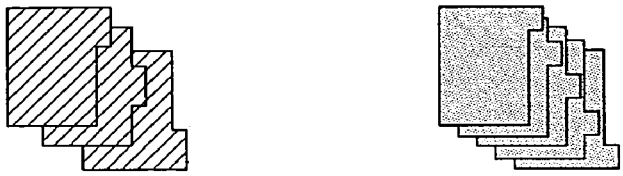
FIG. 11(*a*) is a diagram showing a content of a tab sheet set used in illustrating a conventional technology.
Figure 11:
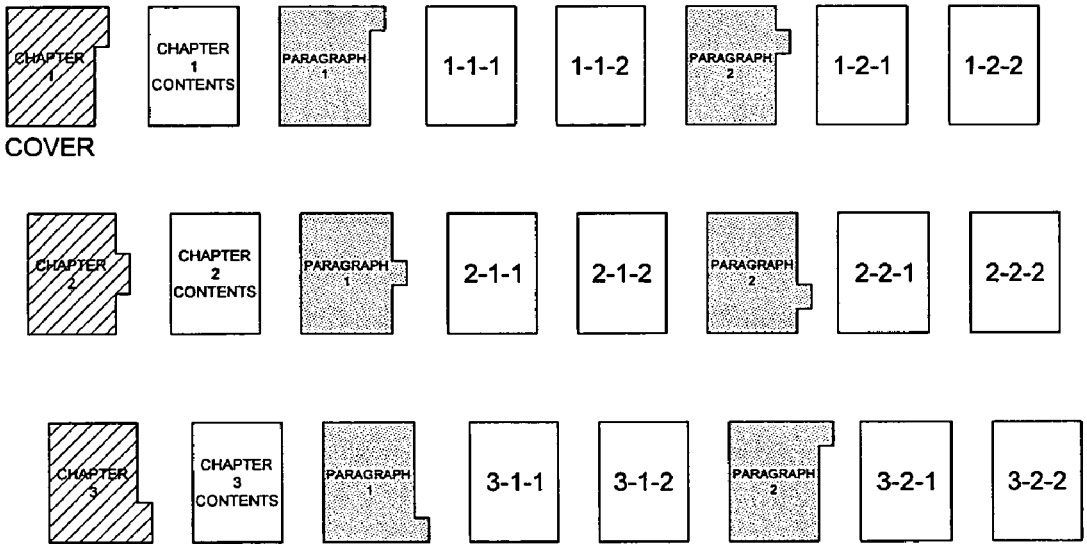

In the same way as in the image forming apparatus shown in the first embodiment, image forming apparatus 300 is equipped with state control section 10 that is equipped with CPU 11 as shown in FIG. 8, and various types of programs such as an unwanted tab sheet ejection processing programs are stored in program memory 12 of the state control section 10, thus, the CPU 11 functions as a control section that practices various types of processing including unwanted tab sheet ejection processing and printing processing, in cooperation with the aforesaid programs. When the number of tab sheets in one set for the tab sheet (special sheet) group to be used in output job is inputted from outside equipment such as operation display section 20 or host apparatus 200, as tab printing setting information, CPU 11 recognizes and sets such information as an information setting section, and causes program memory 12 to store the information. Then, the CPU 11 supplies and conveys transfer sheets and tab sheets from supply trays 87*a*-87*e*, and inserts properly a tab sheet between transfer sheets. Then, after termination of image forming, sheets are conveyed as a set to post-processing section 6 one copy by one copy, so that prescribed post-processing is carried out by controlling FNS controller through a printer controller.

Meanwhile, an explanation of the unwanted tab sheet ejection processing program for conducting unwanted tab sheet ejection processing will be omitted, because it is the same as that explained in the first embodiment.

In addition, the control structure of the control section and the structure of each section of the apparatus are the same as those shown in the first embodiment, therefore, an explanation for them will be omitted, by giving the same symbols to the same items.

Next, operations of image forming apparatus 300 in the present embodiment will be explained.

When pieces of setting information such as a quantity of prints, the presence or absence of instructions for insertion of a cover, a position of insertion in the case of inserting a tab sheet as a blank sheet, the number of tab sheets constituting one set of tab sheet group to be used, types and sizes of transfer sheets to be subjected to recording, and the presence or absence as well as types of post-processing are inputted from outside equipment such as host apparatus 200 and from operation display section 20, concerning print processing, and when instructions for the start of the print processing are inputted, setting information thus inputted are sent to CPU 11 of the state control section 10, and printing processing is started.

Namely, when ADF control section 41 causes ADF 40 to operate after receiving instructions from CPU 11, to supply automatically a document onto a platen glass of image reading section 30 in succession, and when scanner control section 31 causes scanner 32 to operate, the document is read and data of the image thus read are outputted to reading processor

15. The image data thus read are outputted to writing processing section 19, and printer controller 51 causes LD to operate based on the aforesaid image data, whereby, an image is formed on the transfer sheet. Further, tab sheets serving as obverse covers or blank sheets are inserted in transfer sheets conveyed by a conveyance section. After completion of printing for one copy, the aforesaid one copy sent from CPU 11 through print controller 2 is sent to post-processing section 6 as one set, and post-processing such as staple processing is carried out.

In the present embodiment, the presence or absence of unwanted tab sheets is judged before the start of print processing for the subsequent chapter after termination of print processing for each chapter, in the same way as in the first embodiment, and if unwanted tab sheets exist, unwanted tab sheet ejection processing for ejecting the unwanted tab sheets is carried out. This processing is realized by software processing under cooperation between CPU 11 and unwanted tab sheet ejection processing program.

With respect to unwanted tab sheet ejection processing, the presence or absence of instructions for insertion of an obverse cover is judged, and when instructions for insertion of an obverse cover exist, the first tab sheet in a tab sheet group of 3-sheet set loaded in supply tray 87*a* as an obverse cover is inserted. After the obverse cover is inserted, or when the instructions for insertion of an obverse cover do not exist, the presence or absence of instructions for inserting a tab sheet as a blank sheet is judged. When instructions for inserting a blank sheet exist, a judgment is made whether the tab sheets which are further designated to be inserted are those loaded in supply tray 87*a* or not. When the tab sheets loaded in the supply tray 87*a* are designated to be inserted, the number of unwanted tab sheets is calculated. Then, the presence or absence of unwanted tab sheets is judged by the results of the calculation, and when unwanted tab sheets are judged to exist, the unwanted tab sheets in quantity equivalent to the calculated number of unwanted tab sheets are ejected to sheet-ejection tray. Then, a judgment is made whether all of the unwanted tab sheets are ejected or not, and when ejection is completed, and when unwanted tab sheets are judged not to exist in supply tray 87*b*, the second tab sheet of a tab sheet group of 3-sheet set is supplied from supply tray 87*a* as a blank sheet, and is inserted between transfer sheets. Further, when ejection of unwanted tab sheet is not completed, a step returns back again to step 7 to conduct ejection of a tab sheet. On the other hand, when the tab sheets designated to be inserted are not those loaded in supply tray 87*a*, a tab sheet is inserted from supply tray 87*b*. When there is no instruction for inserting a blank sheet, a transfer sheet is supplied from any one of supply trays 87*c*-87*e* as a sheet on which the text of a printed object is printed.

When tab sheets are supplied from supply trays 87*a* and 87*b*, or when a transfer sheet is supplied from any one of supply trays 87*c*-87*e*, a judgment is made whether a subsequent page exists or not. When the subsequent page exists, the aforesaid processing is repeated after image forming processing for the subsequent page is conducted. When the subsequent page does not exist, the number of unwanted tab sheets in the supply tray 87*a* and the number of unwanted tab sheets in the supply tray 87*b* are calculated. Then, whether the unwanted tab sheets exist or not is judged from the results of the calculation, and when the unwanted tab sheets are judged to exist, respective tab sheets in quantity equivalent to the calculated number are ejected to the sheet-ejection tray. Then, a judgment is made whether all of the unwanted tab sheets are ejected or not, and when ejection of unwanted tab sheets is not completed, ejections of tab sheets are conducted until unwanted tab sheets are entirely ejected. When the ejection is completed, and when unwanted tab sheets are judged not to exist in supply trays 87*a* and 87*b*, a judgment is made whether printings equivalent to the number of copies expected as printing job are entirely completed or not. When printing for all copies is completed, that output job is terminated, while when the printing is not completed, the aforesaid each processing is repeated until the printing for all copies is completed.

In the present embodiment, as stated above, before new tab sheet is supplied from the first tab sheet group used in the first of print processing for each copy, the presence or absence of excessive tab sheets is judged concerning the second tab sheet group to be inserted in the first tab sheet group, and excessive tab sheets are ejected properly. Owing to this, when inserting a tab sheet in a separation of each "chapter" and each "paragraph", for example, it is possible to arrange so that the first tab sheet of a tab sheet group for dividing "paragraph" may come not only to the forefront of each copy but also to the forefront of each chapter.

Incidentally, in the present embodiment, a tab sheet for dividing each paragraph is reset for the separation of each chapter, and ejection processing for unwanted tab sheets is conducted so that the first tab sheet of the tab sheet group for dividing "paragraph" may come also to the forefront of each chapter. However, it is also possible to make rollers 88 representing a conveyance section to be controllable, so that, for example, CPU 11 may judge the presence or absence of unwanted tab sheet for tab sheets of plural types, each time the output job for one copy is completed, and unwanted tab sheet may be ejected, if any, in the same way as in the first embodiment.

In this case, the CPU 11 may make the control of conducting ejection processing for unwanted tab sheets to be possible so that the first tab sheet of a tab sheet group for dividing a "paragraph" may come also to the forefront of each chapter, and thereby to make the selection of the timing to conduct ejection of unwanted tab sheets to be possible. When the selection of the timing to conduct ejection of unwanted tab sheets is made to be possible, host apparatus 200 or operation display section 20 functions as a selection section to select the ejection timing.

According to another aspect of the preferred embodiment of the present invention, before a special sheet of the second special sheet group is inserted after a new special sheet is supplied from the first special sheet group, a special sheet constituting the same set together with a special sheet supplied immediately before in the second special sheet group, is ejected, as an unwanted special sheet, to a target of ejection that is different from that for finished outputted objects such as a booklet. Owing to this, it is possible to arrange so that the first special sheet of the special sheet group for dividing a "paragraph" may come not only to the forefront of each copy but also to the forefront of each chapter, when using plural types of special sheets including a special sheet for dividing a "chapter" and a special sheet for dividing a "paragraph". Due to this, there is exhibited an effect that it is possible to make a booklet having a type to reset special sheets for dividing a "paragraph" for each chapter to insert them successively from the first sheet.

According to another aspect of the preferred embodiment of the present invention, unwanted special sheets are ejected thoroughly because a target for ejection of unwanted special sheets is located outside the image forming apparatus. Accordingly, there is exhibited an effect to prevent that the ejected special sheets are mixed in a finished output object.

According to another aspect of the preferred embodiment of the present invention, a special sheet of the second special sheet group that is placed primarily after a special sheet of the first special sheet group is placed, becomes a headmost special sheet constituting one set of the second special sheet group. Therefore, when a special sheet of the first special sheet group is a special sheet for dividing a "chapter" and a special sheet of the second special sheet group is a special sheet for dividing a "paragraph", for example, it is possible to arrange so that the first special sheet of the special sheet group for dividing a "paragraph" may come also to the forefront of each chapter. Due to this, there is exhibited an effect that it is possible to make a booklet having a type to reset special sheets for dividing a "paragraph" for each chapter to insert them successively from the first sheet.

According to another aspect of the preferred embodiment of the present invention, unwanted special sheets among special sheets constituting the first special sheet group and the second special sheet group are ejected, after production of output object of one copy, whereby, there is exhibited an effect that it is possible to make a booklet having a type wherein a special sheet for dividing a "paragraph" is reset for each chapter, then, a special sheet is reset each time an output for one copy is terminated, and special sheets are inserted successively for the separation of one copy and for the separation of each chapter.

According to another aspect of the preferred embodiment of the present invention, image recording is conducted while inserting a tab sheet or a color sheet between transfer sheets as a special sheet. Due to this, there is exhibited an effect that it is possible to make a booklet wherein separations for each of "chapter" and "paragraph" are readily understandable and are easy to see.

According to another aspect of the preferred embodiment of the present invention, when the number of special sheets of the second special sheet group inserted between two special sheets supplied from the first specific group is not an integral multiple of the number of the special sheets, unwanted special sheets among the second special sheet group are ejected, whereby, there is exhibited an effect that it is possible to make a booklet having a type to eject properly excessive special sheets and to insert special sheets beginning with the first special sheet, for the separation of each chapter.

According to another aspect of the preferred embodiment of the present invention, the number of unwanted special sheets to be ejected is calculated by the use of an expression, whereby, there is exhibited an effect that it is possible to make a booklet having a type to grasp the number of special sheets to be ejected simply and firmly, and thereby to eject properly excessive special sheets for inserting special sheets successively for the separation of each chapter, beginning with the first special sheet.

The present invention is not limited to the aforesaid embodiment, and the embodiment can be varied without departing from the spirit and scope of the invention, which is the same as in the first embodiment.

What is claimed is:

1. An image forming apparatus, comprising:

a first supply section which supplies a first-type special sheet of a first special sheet group, the first special sheet group including first special sheet sets, each set of which containing a plurality of different kind of first-type special sheets arranged in a predetermined order;

a second supply section which supplies a second-type special sheet of a second special sheet group, the second-type special sheet of the second special sheet group being to be inserted between first-type special sheets of the first special sheet group, the second special sheet group including second special sheet sets, each set of which contains a plurality of different kind of second-type special sheets arranged in a predetermined order;

a stacking section which stacks the first-type special sheet supplied by the first supply section and the second-type special sheet supplied by the second supply section;

a conveyance section which conveys at least one second-type special sheet of the second special sheet group so as to be inserted between two first-type special sheets supplied by the first supply section on the stacking section; and a control section which controls the second supply section and the conveyance section so that a rest of second-type special sheets which belong to the same set as a second-type special sheet having been last supplied by the second supply section is supplied by the second supply section and is ejected to a sheet ejection destination other than the stacking section before a second-type special sheet of the second special sheet group is inserted after the latter sheet of the two first-type special sheets supplied by the first supply section.

2. The image forming apparatus of claim 1, wherein the sheet ejection destination is out of the image forming apparatus.

3. The image forming apparatus of claim 1, wherein the control section controls the second supply section 50 that a special sheet of the second special sheet group which is first stacked after the special sheet of the first special sheet group is stacked on the stacking section is a top special sheet in the second special sheet set.

4. The image forming apparatus of claim 1, wherein in case of producing a plurality of output objects, each of which includes a first-type special sheet of the first special sheet group and a second-type special sheet of the second special sheet group, after producing one of the output objects, the control section controls the first supply section, the second supply section and the conveyance section 50 that a rest of first-type special sheets which belong to the same set as a first-type special sheet having been last supplied by the first supply section and a rest of second-type special sheets which belong to the same set as a second-type special sheet having been last supplied by the second supply section are supplied and ejected to a sheet ejection destination other than the stacking section.

5. The image forming apparatus of claim 1, wherein a special sheet of the first special sheet group and the second special sheet group is a tabbed paper or a colored sheet.

6. The image forming apparatus of claim 1, comprising:

a memory section which stores a number of special sheets included in the second special sheet set, wherein in case that a number of special sheets of the second special sheet group inserted between the two special sheets supplied by the first supply section is not an integral multiple of the number stored in the memory section, the control section controls the second supply section and the conveyance section so that a rest of special sheets which belong to the same set as a special sheet having been last supplied by the second supply section is supplied by the second supply section and is ejected to a sheet ejection destination other than the stacking section.

7. The image forming apparatus of claim 6, wherein the control section controls the second supply section and the conveyance section so that special sheets of the second special sheet group of a number A which satisfies the following relation ship is supplied and ejected to a sheet ejection destination other than the stacking section:

$$A=m1-m2, \text{ (in case of } m1>m2)$$

$$A=m1-(\text{remainder of } m2/m1), \text{ (in case of } m1<m2)$$

wherein:

m1 is a number of special sheets stored in the memory section;

m2 is a number of special sheets of the second special sheet group inserted between two special sheet supplied from the first special sheet group.

8. An image forming system, comprising:

an image forming apparatus which includes an image forming section forming an image on a recording medium based on input data; and a post-processing apparatus including a post-processing section which post-processes the recording medium after the image is formed on the recording medium by the image forming apparatus, wherein the image forming system includes a first supply section which supplies a first-type special sheet of a first special sheet group, the first special sheet group including first special sheet sets, each set of which containing a plurality of different kind of first-type special sheets arranged in a predetermined order;

a second supply section which supplies a second-type special sheet of a second special sheet group, the second-type special sheet of the second special sheet group being to be inserted between first-type special sheets of the first special sheet group, the second special sheet group including second special sheet sets, each set of which containing a plurality of different kind of second-type special sheets arranged in a predetermined order;

a stacking section which stacks the first-type special sheet supplied by the first supply section and the second-type special sheet supplied by the second supply section;

a conveyance section which conveys at least one second-type special sheet of the second special sheet group so as to be inserted between two first-type special sheets supplied by the first supply section on the stacking section; and a control section which controls the second supply section and the conveyance section so that a rest of second-type special sheets which belong to the same set as a second-type special sheet having been last supplied by the second supply section is supplied by the second supply section and is ejected to a sheet ejection destination other than the stacking section before a second-type special sheet of the second special sheet group is inserted after the latter sheet of the two first-type special sheets supplied by the first supply section.

9. The image forming system of claim 8, wherein the sheet ejection destination is out of the image forming system.

10. The image forming system of claim 8, wherein the control section controls the second supply section so that a special sheet of the second special sheet group which is first stacked after the special sheet of the first special sheet group is stacked on the stacking section is a top special sheet in the second special sheet set.

11. The image forming system of claim 8, wherein in case of producing a plurality of output objects, each of which includes a first-type special sheet of the first special sheet group and a second-type special sheet of the second special sheet group, after producing one of the output objects, the control section controls the first supply section, the second supply section and the conveyance section so that a rest of first-type special sheets which belong to the same set as a first-type special sheet having been last supplied by the first supply section and a rest of second-type special sheets which belong to the same set as a second-type special sheet having been last supplied by the second supply section are supplied and ejected to a sheet ejection destination other than the stacking section.

12. The image forming system of claim 8, wherein a special sheet of the first special sheet group and the second special sheet group is a tabbed paper or a colored sheet.

13. The image forming system of claim 8, comprising:

a memory section which stores a number of special sheets included in the second special sheet set, wherein in case that a number of special sheets of the second special sheet group inserted between the two special sheets supplied by the first supply section is not an integral multiple of the number stored in the memory section, the control section controls the second supply section and the conveyance section so that a rest of special sheets which belong to the same set as a special sheet having been last supplied by the second supply section is supplied by the second supply section and is ejected to a sheet ejection destination other than the stacking section.

14. The image forming system of claim 13, wherein the control section controls the second supply section and the conveyance section so that special sheets of the second special sheet group of a number A which satisfies the following relation ship is supplied and ejected to a sheet ejection destination other than the stacking section:

$$A=m1-m2, \text{ (in case of } m1>m2)$$

$$A=m1-(\text{remainder of } m2/m1), \text{ (in case of } m1<m2)$$

wherein:

m1 is a number of special sheets stored in the memory section;

m2 is a number of special sheets of the second special sheet group inserted between two special sheet supplied from the first special sheet group.

15. A computer readable storage medium storing a program for enabling a computer to make an image forming system, which forms an image on a recording medium based on input data, execute a method, the method comprising the steps of:

conveying at least one second-type special sheet of a second special sheet group including second special sheet sets, each set of which contains a plurality of different kind of second-type special sheets arranged in a predetermined order so that a second-type special sheet of the second special sheet group is inserted between two first-type special sheets of a first special sheet group on a stacking section, the first special sheet group including first special sheet sets, each set of which contains a plurality of different kind of first-type special sheets arranged in a predetermined order; and supplying a rest of second-type special sheets which belong to the same set as a second-type special sheet of the second special sheet group having been last supplied and ejecting the rest of second-type special sheets to a sheet ejection destination before a second-type special sheet of the second special sheet group is inserted after the latter sheet of the two first-type special sheets supplied from the first special sheet group.

16. The computer readable storage medium of claim 15, wherein the sheet ejection destination is out of the image forming system.

17. The computer readable storage medium of claim 15, wherein the program enables the computer to make the image forming system execute the step of:

supplying a special sheet of the second special sheet group so that a special sheet of the second special sheet group which is first stacked after the special sheet of the first special sheet group is stacked on the stacking section is a top special sheet in the second special sheet set.

18. The computer readable storage medium of claim 15, wherein the program enables the computer to make the image forming system execute the step of:

supplying, in case of producing a plurality of output objects, each of which includes a first-type special sheet of the first special sheet group and a second-type special sheet of the second special sheet group, a rest of first-type special sheets which belong to the same set as a first-type special sheet of the first special sheet group having been last supplied and a rest of second-type special sheets which belong to the same set as a second-type special sheet of the second special sheet group having been last supplied and ejecting to a sheet ejection destination other than the stacking section after producing one of the output objects.

19. The computer readable storage medium of claim 15, wherein a special sheet of the first special sheet group and the second special sheet group is a tabbed paper or a colored sheet.

20. The computer readable storage medium of claim 15, wherein the program enables the computer to make the image forming system execute the steps of:

storing a number of special sheets included in the second special sheet set in a memory section; and supplying, in case that a number of special sheets of the second special sheet group inserted between the two special sheets supplied by the first supply section is not an integral multiple of the number stored in the memory section, a rest of special sheets which belong to the same set as a special sheet having been last supplied by the second supply section and ejecting the rest to a sheet ejection destination other than the loading section by ejecting the rest of the special sheet set.

21. The computer readable storage medium of claim 20, wherein the program enables the computer to make the image forming system execute the step of:

supplying special sheets of the second special sheet group of a number A which satisfies the following relationship to a sheet ejection destination other than the stacking section by supplying the special sheet:

$$A=m1-m2, \text{ (in case of } m1>m2)$$

$$A=m1-(\text{remainder of } m2/m1), \text{ (in case of } m1<m2)$$

wherein:

m1 is a number of special sheets stored in the memory section;

m2 is a number of special sheets of the second special sheet group inserted between two special sheet supplied from the first special sheet group.

* * * * *

UNITED STATES PATENT AND TRADEMARK OFFICE

CERTIFICATE OF CORRECTION

PATENT NO. : 7,603,072 B2
APPLICATION NO. : 11/410134
DATED : October 13, 2009
INVENTOR(S) : Yokobori et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 570 days.

Signed and Sealed this

Fifth Day of October, 2010

David J. Kappos

David J. Kappos
*Director of the United States Patent and Trademark Office*